US006352335B1

(12) United States Patent
Koyama et al.

(10) Patent No.: US 6,352,335 B1
(45) Date of Patent: Mar. 5, 2002

(54) BIDIRECTIONAL PRINTING CAPABLE OF RECORDING ONE PIXEL WITH ONE OF DOT-SIZES

(75) Inventors: Minoru Koyama; Kiyoshi Mukaiyama; Koichi Otsuki; Noboru Asauchi, all of Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/445,446

(22) PCT Filed: Apr. 13, 1999

(86) PCT No.: PCT/JP99/01971

§ 371 Date: Dec. 14, 1999

§ 102(e) Date: Dec. 14, 1999

(87) PCT Pub. No.: WO99/52712

PCT Pub. Date: Oct. 21, 1999

(30) Foreign Application Priority Data

Apr. 14, 1998 (JP) ..... 10-121705

(51) Int. Cl.[7] ..... B41J 23/00; B41J 29/38

(52) U.S. Cl. ..... 347/37; 347/10; 347/11

(58) Field of Search ..... 347/15, 10, 11, 347/37, 14

(56) References Cited

U.S. PATENT DOCUMENTS 5,992,972 A * 11/1999 Nagoshi et al. ..... 347/43

OTHER PUBLICATIONS

Ser. No. 09/228,969, filed Jan. 12, 1999, pending.
Ser. No. 09/245,844, filed Feb. 8, 1999, pending.
Ser. No. 09/366,596, filed Aug. 3, 1999, pending.
Ser. No. 09/374,845, filed Aug. 16, 1999, pending.
Ser. No. 09/445,446, filed Dec. 14, 1999, pending.
Ser. No. 09/461,396, filed Dec. 15, 1999, pending.
Ser. No. 09/461,620, filed Dec. 15, 1999, pending.
Ser. No. 09/461,307, filed Dec. 15, 1999, pending.
Ser. No. 09/445,446, filed Dec. 14, 1999, pending.
Ser. No. 09/588,712, filed Jun. 7, 2000, pending.
Ser. No. 09/445,446, filed Dec. 14, 1999, pending.
Ser. No. 09/496,407, filed Feb. 2, 2000, pending.
Ser. No. 09/534,339, filed Mar. 24, 2000, pending.
Ser. No. 09/445,446, filed Dec. 14, 1999, pending.
Ser. No. 09/497,177, filed Feb. 3, 2000, pending.
Ser. No. 09/497,168, filed Feb. 3, 2000, pending.
Ser. No. 09/445,446, filed Dec. 14, 1999, pending.
Ser. No. 09/642,909, filed Aug. 22, 2000, pending.

* cited by examiner

*Primary Examiner*—Thinh Nguyen
(74) *Attorney, Agent, or Firm*—Oblon, Spivak, McClelland, Maier & Neustadt, P.C.

(57) ABSTRACT

A shape of the drive signal within each one-pixel period of main scan is modified to have N different waveforms corresponding to N different values of the print signal, the N different values of the print signal representing formation of the N different dots. The N different waveforms of the drive signal are changed between the forward pass and the reverse pass. This will align the hitting positions of ink droplets in the main scanning direction during forward and reverse passes.

19 Claims, 29 Drawing Sheets

FIRST EMBODIMENT

FIRST EMBODIMENT

FIRST EMBODIMENT

Fig. 14(a) SECOND EMBODIMENT
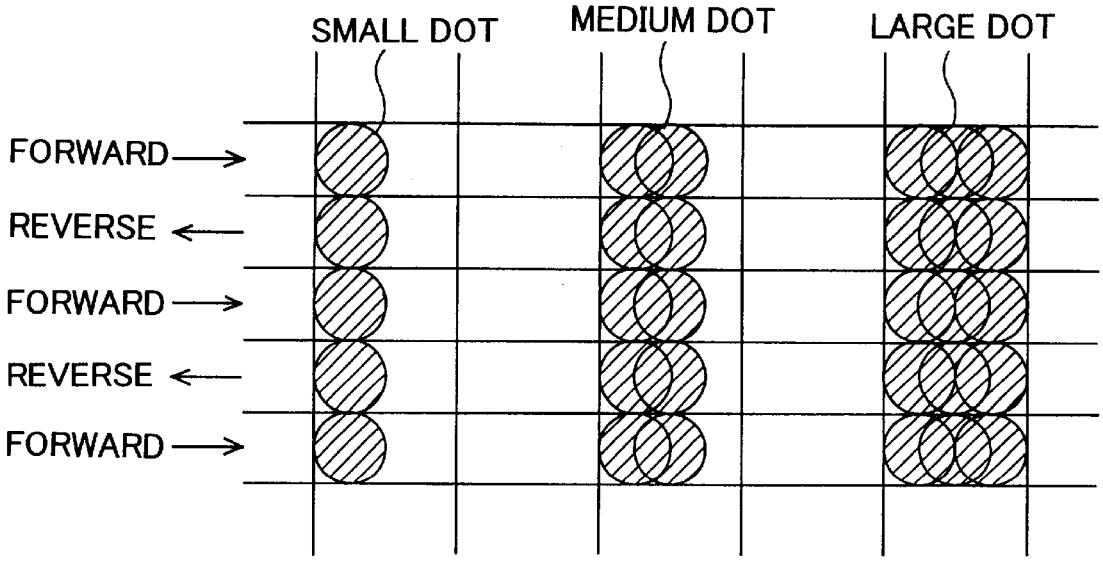
Fig. 14(b) PRIOR ART
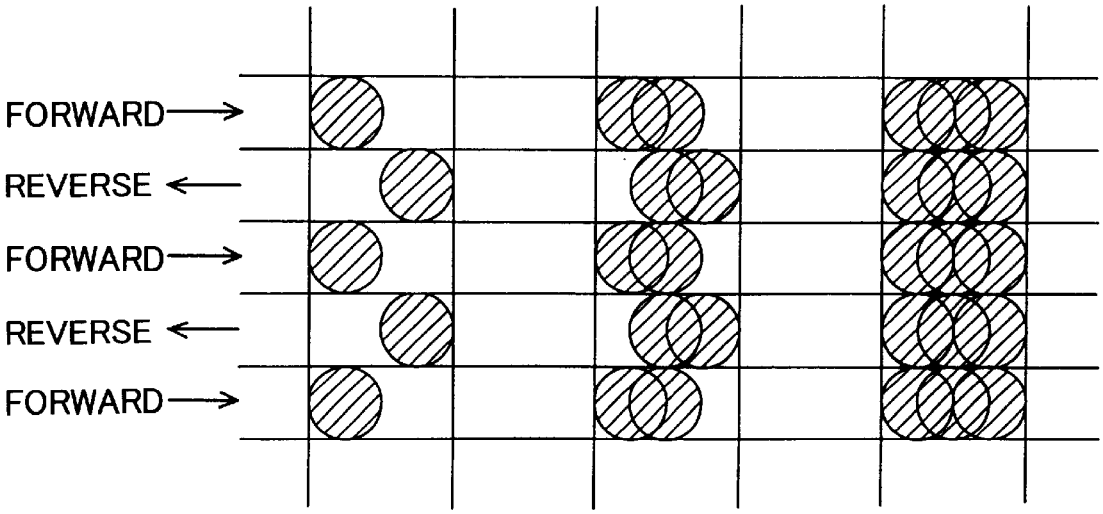

THIRD EMBODIMENT

FOURTH EMBODIMENT

Fig. 19(a) LD
Δ1
Δ0
Fig. 19(b) DRV0
Fig. 19(c) CLK
Fig. 19(d) ADDINC
n0
n1

Fig. 20

ROM310

WAVEFORM DATA FOR REVERSE PASS

WAVEFORM DATA FOR FORWARD PASS

| | |
|---|---|
| n0 | Δ0 |
| n1 | Δ1 |
| n2 | Δ2 |
| • | • |
| • | • |
| • | • |
| n31 | Δ31 |

WAVEFORMS OF DRIVE SIGNAL AND MASKING SIGNAL IN FORWARD PASS (FOURTH EMBODIMENT)

WAVEFORMS OF DRIVE SIGNAL AND MASKING SIGNAL IN FORWARD PASS (FOURTH EMBODIMENT)

FOURTH EMBODIMENT

Fig. 26(A) TRUTH TABLE IN FORWARD PASS (FOURTH EMBODIMENT)

| DH DL | V3 | V2 | V1 | V0 | /Q3 | /Q2 | /Q1 | /Q0 | MSK | PERIOD |
|---|---|---|---|---|---|---|---|---|---|---|
| 0 0 | 0 | 0 | 0 | 1 | 0 | 0 | 0 | 1 | 1 | T21 |
| (NO DOT) | 1 | 0 | 0 | 0 | 0 | 0 | 0 | 0 | 0 | T22 |
| | 0 | 0 | 1 | 0 | 0 | 0 | 0 | 0 | 0 | T23 |
| | 0 | 1 | 0 | 0 | 0 | 0 | 0 | 0 | 0 | T24 |
| 0 1 | 0 | 0 | 0 | 1 | 0 | 0 | 0 | 0 | 0 | T21 |
| (SMALL) | 1 | 0 | 0 | 0 | 0 | 0 | 0 | 0 | 0 | T22 |
| | 0 | 0 | 1 | 0 | 0 | 0 | 1 | 0 | 1 | T23 |
| | 0 | 1 | 0 | 0 | 0 | 0 | 0 | 0 | 0 | T24 |
| 1 0 | 0 | 0 | 0 | 1 | 0 | 0 | 0 | 0 | 0 | T21 |
| (MEDIUM) | 1 | 0 | 0 | 0 | 0 | 0 | 0 | 0 | 0 | T22 |
| | 0 | 0 | 1 | 0 | 0 | 0 | 0 | 0 | 0 | T23 |
| | 0 | 1 | 0 | 0 | 0 | 1 | 0 | 0 | 1 | T24 |
| 1 1 | 0 | 0 | 0 | 1 | 0 | 0 | 0 | 0 | 0 | T21 |
| (LARGE) | 1 | 0 | 0 | 0 | 1 | 0 | 0 | 0 | 1 | T22 |
| | 0 | 0 | 1 | 0 | 0 | 0 | 0 | 0 | 0 | T23 |
| | 0 | 1 | 0 | 0 | 0 | 0 | 0 | 0 | 0 | T24 |

Fig. 26(B) TRUTH TABLE IN FORWARD PASS (FOURTH EMBODIMENT)

| DH DL | V3 | V2 | V1 | V0 | /Q3 | /Q2 | /Q1 | /Q0 | MSK | PERIOD |
|---|---|---|---|---|---|---|---|---|---|---|
| 0 0 | 0 | 0 | 0 | 1 | 0 | 0 | 0 | 1 | 1 | T25 |
| (NO DOT) | 0 | 1 | 0 | 0 | 0 | 0 | 0 | 0 | 0 | T26 |
| | 0 | 0 | 1 | 0 | 0 | 0 | 0 | 0 | 0 | T27 |
| | 1 | 0 | 0 | 0 | 0 | 0 | 0 | 0 | 0 | T28 |
| 0 1 | 0 | 0 | 0 | 1 | 0 | 0 | 0 | 0 | 0 | T25 |
| (SMALL) | 0 | 1 | 0 | 0 | 0 | 0 | 0 | 0 | 0 | T26 |
| | 0 | 0 | 1 | 0 | 0 | 0 | 1 | 0 | 1 | T27 |
| | 1 | 0 | 0 | 0 | 0 | 0 | 0 | 0 | 0 | T28 |
| 1 0 | 0 | 0 | 0 | 1 | 0 | 0 | 0 | 0 | 0 | T25 |
| (MEDIUM) | 0 | 1 | 0 | 0 | 0 | 1 | 0 | 0 | 1 | T26 |
| | 0 | 0 | 1 | 0 | 0 | 0 | 0 | 0 | 0 | T27 |
| | 1 | 0 | 0 | 0 | 0 | 0 | 0 | 0 | 0 | T28 |
| 1 1 | 0 | 0 | 0 | 1 | 0 | 0 | 0 | 0 | 0 | T25 |
| (LARGE) | 0 | 1 | 0 | 0 | 0 | 0 | 0 | 0 | 0 | T26 |
| | 0 | 0 | 1 | 0 | 0 | 0 | 0 | 0 | 0 | T27 |
| | 1 | 0 | 0 | 0 | 1 | 0 | 0 | 0 | 1 | T28 |

WAVEFORMS OF DRIVE SIGNAL AND MASKING SIGNAL IN FORWARD PASS (FIFTH EMBODIMENT)
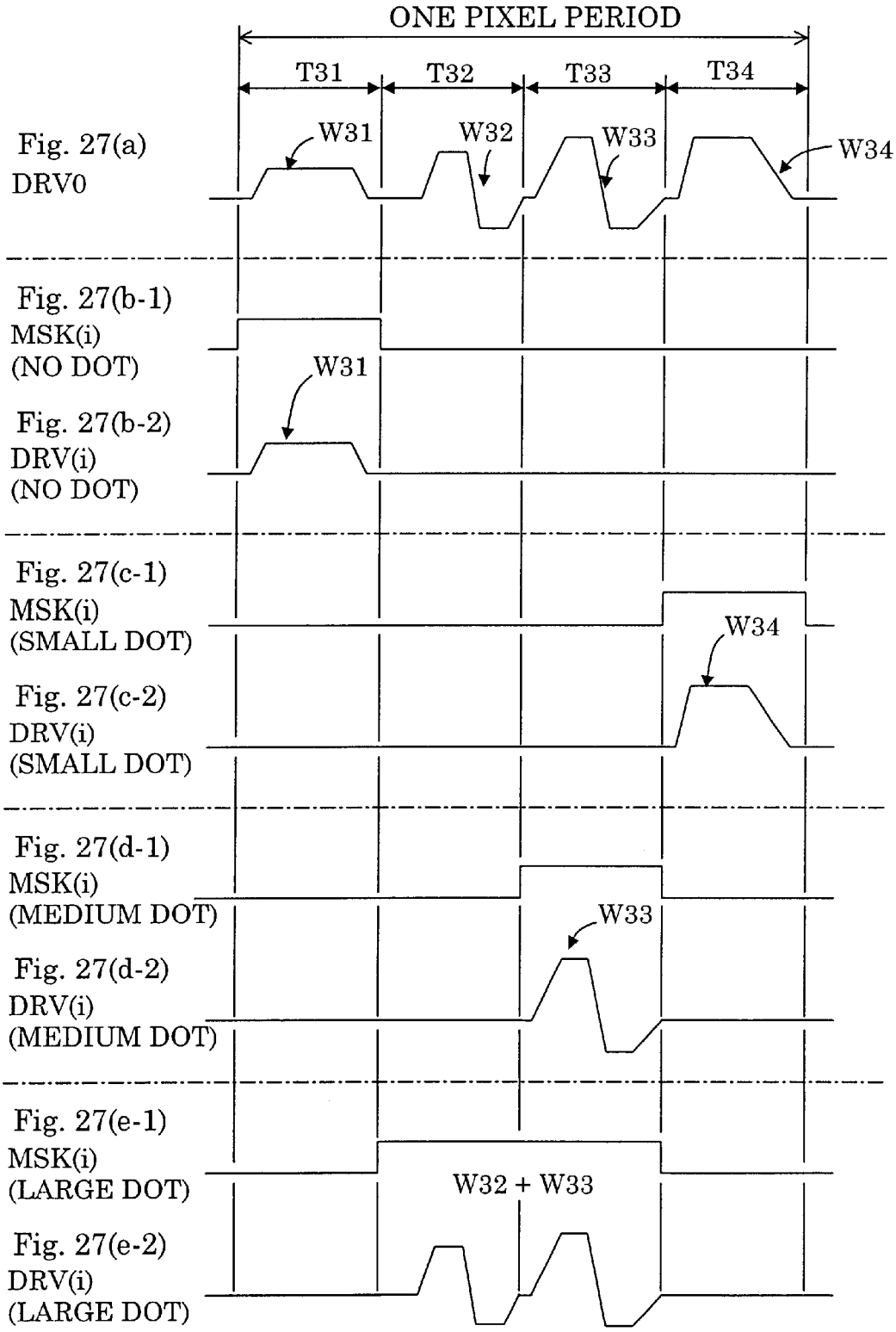

WAVEFORMS OF DRIVE SIGNAL AND MASKING SIGNAL IN REVERSE PASS (FIFTH EMBODIMENT)
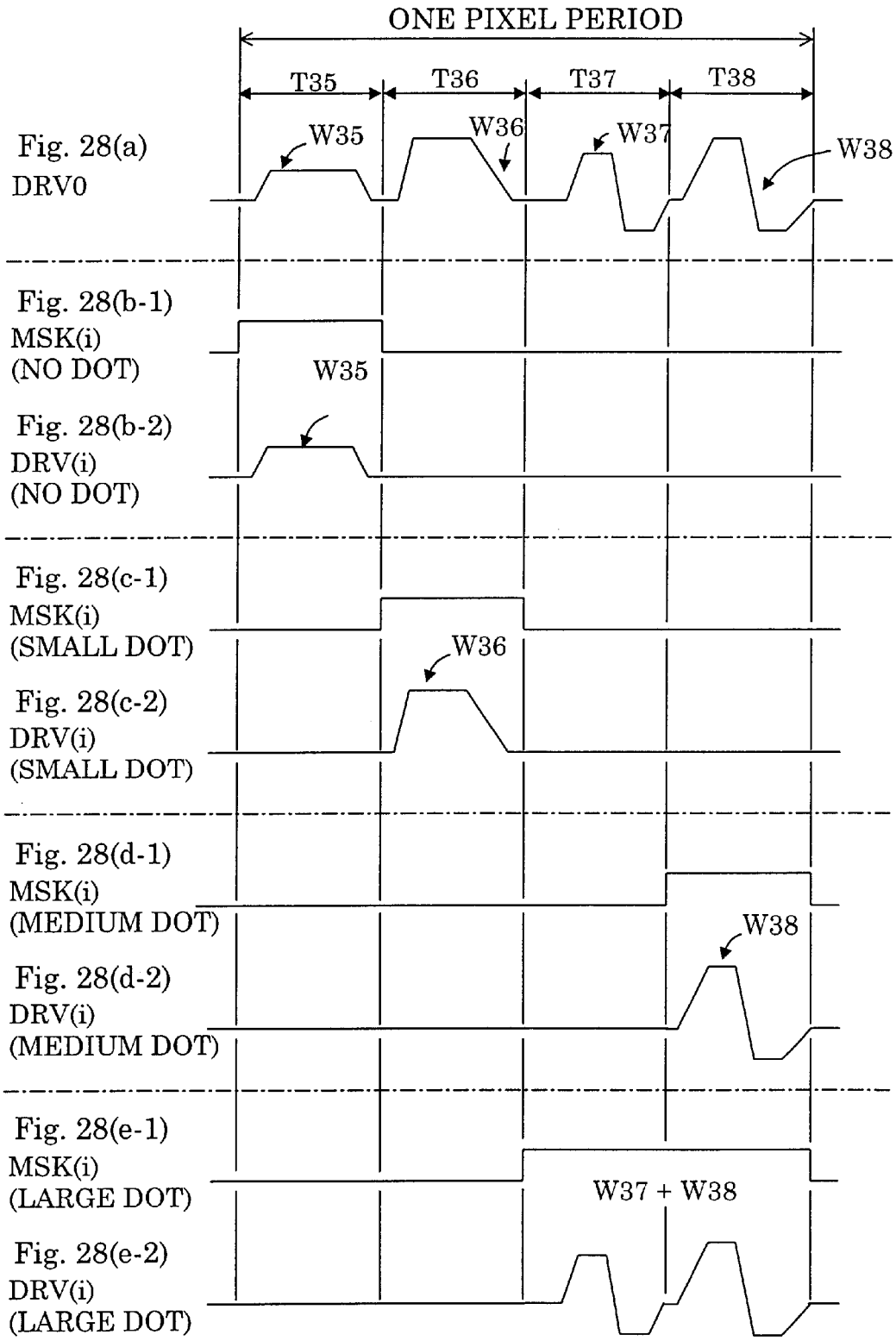

Fig. 29(A) TRUTH TABLE IN FORWARD PASS (FIFTH EMBODIMENT)

| DH DL | V3 | V2 | V1 | V0 | /Q3 | /Q2 | /Q1 | /Q0 | MSK | PERIOD |
|---|---|---|---|---|---|---|---|---|---|---|
| 0 0 | 0 | 0 | 0 | 1 | 0 | 0 | 0 | 1 | 1 | T31 |
| (NO DOT) | 1 | 0 | 0 | 0 | 0 | 0 | 0 | 0 | 0 | T32 |
| | 1 | 1 | 0 | 0 | 0 | 0 | 0 | 0 | 0 | T33 |
| | 0 | 0 | 1 | 0 | 0 | 0 | 0 | 0 | 0 | T34 |
| 0 1 | 0 | 0 | 0 | 1 | 0 | 0 | 0 | 0 | 0 | T31 |
| (SMALL) | 1 | 0 | 0 | 0 | 0 | 0 | 0 | 0 | 0 | T32 |
| | 1 | 1 | 0 | 0 | 0 | 0 | 0 | 0 | 0 | T33 |
| | 0 | 0 | 1 | 0 | 0 | 0 | 1 | 0 | 1 | T34 |
| 1 0 | 0 | 0 | 0 | 1 | 0 | 0 | 0 | 0 | 0 | T31 |
| (MEDIUM) | 1 | 0 | 0 | 0 | 0 | 0 | 0 | 0 | 0 | T32 |
| | 1 | 1 | 0 | 0 | 0 | 1 | 0 | 0 | 1 | T33 |
| | 0 | 0 | 1 | 0 | 0 | 0 | 0 | 0 | 0 | T34 |
| 1 1 | 0 | 0 | 0 | 1 | 0 | 0 | 0 | 0 | 0 | T31 |
| (LARGE) | 1 | 0 | 0 | 0 | 1 | 0 | 0 | 0 | 1 | T32 |
| | 1 | 1 | 0 | 0 | 1 | 0 | 0 | 0 | 1 | T33 |
| | 0 | 0 | 1 | 0 | 0 | 0 | 0 | 0 | 0 | T34 |

Fig. 29(B) TRUTH TABLE IN FORWARD PASS (FIFTH EMBODIMENT)

| DH DL | V3 | V2 | V1 | V0 | /Q3 | /Q2 | /Q1 | /Q0 | MSK | PERIOD |
|---|---|---|---|---|---|---|---|---|---|---|
| 0 0 | 0 | 0 | 0 | 1 | 0 | 0 | 0 | 1 | 1 | T35 |
| (NO DOT) | 0 | 0 | 1 | 0 | 0 | 0 | 0 | 0 | 0 | T36 |
| | 1 | 0 | 0 | 0 | 0 | 0 | 0 | 0 | 0 | T37 |
| | 1 | 1 | 0 | 0 | 0 | 0 | 0 | 0 | 0 | T38 |
| 0 1 | 0 | 0 | 0 | 1 | 0 | 0 | 0 | 0 | 0 | T35 |
| (SMALL) | 0 | 0 | 1 | 0 | 0 | 0 | 1 | 0 | 1 | T36 |
| | 1 | 0 | 0 | 0 | 0 | 0 | 0 | 0 | 0 | T37 |
| | 1 | 1 | 0 | 0 | 0 | 0 | 0 | 0 | 0 | T38 |
| 1 0 | 0 | 0 | 0 | 1 | 0 | 0 | 0 | 0 | 0 | T35 |
| (MEDIUM) | 0 | 0 | 1 | 0 | 0 | 0 | 0 | 0 | 0 | T36 |
| | 1 | 0 | 0 | 0 | 0 | 0 | 0 | 0 | 0 | T37 |
| | 1 | 1 | 0 | 0 | 0 | 1 | 0 | 0 | 1 | T38 |
| 1 1 | 0 | 0 | 0 | 1 | 0 | 0 | 0 | 0 | 0 | T35 |
| (LARGE) | 0 | 0 | 1 | 0 | 0 | 0 | 0 | 0 | 0 | T36 |
| | 1 | 0 | 0 | 0 | 1 | 0 | 0 | 0 | 1 | T37 |
| | 1 | 1 | 0 | 0 | 1 | 0 | 0 | 0 | 1 | T38 |

Fig. 30(A) TRUTH TABLE IN FORWARD PASS (SIXTH EMBODIMENT)

| DH DL | V3 | V2 | V1 | V0 | /Q3 | /Q2 | /Q1 | /Q0 | MSK |
|---|---|---|---|---|---|---|---|---|---|
| 0 0 | 1 | 1 | 1 | 0 | 0 | 0 | 0 | 0 | 0 |
| (NO DOT) | 1 | 1 | 0 | 0 | 0 | 0 | 0 | 0 | 0 |
| | 1 | 0 | 0 | 0 | 0 | 0 | 0 | 0 | 0 |
| 0 1 | 1 | 1 | 1 | 0 | 0 | 0 | 1 | 0 | 1 |
| (SMALL) | 1 | 1 | 0 | 0 | 0 | 0 | 0 | 0 | 0 |
| | 1 | 0 | 0 | 0 | 0 | 0 | 0 | 0 | 0 |
| 1 0 | 1 | 1 | 1 | 0 | 0 | 1 | 0 | 0 | 1 |
| (MEDIUM) | 1 | 1 | 0 | 0 | 0 | 1 | 0 | 0 | 1 |
| | 1 | 0 | 0 | 0 | 0 | 0 | 0 | 0 | 0 |
| 1 1 | 1 | 1 | 1 | 0 | 1 | 0 | 0 | 0 | 1 |
| (LARGE) | 1 | 1 | 0 | 0 | 1 | 0 | 0 | 0 | 1 |
| | 1 | 0 | 0 | 0 | 1 | 0 | 0 | 0 | 1 |

Fig. 30(B) TRUTH TABLE IN FORWARD PASS (SIXTH EMBODIMENT)

| DH DL | V3 | V2 | V1 | V0 | /Q3 | /Q2 | /Q1 | /Q0 | MSK |
|---|---|---|---|---|---|---|---|---|---|
| 0 0 | 1 | 0 | 0 | 0 | 0 | 0 | 0 | 0 | 0 |
| (NO DOT) | 1 | 1 | 0 | 0 | 0 | 0 | 0 | 0 | 0 |
| | 1 | 1 | 1 | 0 | 0 | 0 | 0 | 0 | 0 |
| 0 1 | 1 | 0 | 0 | 0 | 0 | 0 | 0 | 0 | 0 |
| (SMALL) | 1 | 1 | 0 | 0 | 0 | 0 | 0 | 0 | 0 |
| | 1 | 1 | 1 | 0 | 0 | 0 | 1 | 0 | 1 |
| 1 0 | 1 | 0 | 0 | 0 | 0 | 0 | 0 | 0 | 0 |
| (MEDIUM) | 1 | 1 | 0 | 0 | 0 | 1 | 0 | 0 | 1 |
| | 1 | 1 | 1 | 0 | 0 | 1 | 0 | 0 | 1 |
| 1 1 | 1 | 0 | 0 | 0 | 1 | 0 | 0 | 0 | 1 |
| (LARGE) | 1 | 1 | 0 | 0 | 1 | 0 | 0 | 0 | 1 |
| | 1 | 1 | 1 | 0 | 1 | 0 | 0 | 0 | 1 |

BIDIRECTIONAL PRINTING CAPABLE OF RECORDING ONE PIXEL WITH ONE OF DOT-SIZES

INDUSTRIAL FIELD

This invention relates to a technology for printing an image on print media using a bi-directional reciprocating movement in a main scanning direction, and more specifically to a technology of bi-directional printing for recording each pixel with a variable-size ink dot.

BACKGROUND ART

In recent years color printers that emit colored inks from a print-head are coming into widespread use as computer output devices. Some of these inkjet color printers have the function of 'bi-directional printing', in order to increase the printing speed.

The conventional inkjet printer prints each pixel with two levels, that is, on and off. Multilevel printers have recently been proposed, which prints each pixel with three or more values. The multilevel pixels are formed, for example, by emitting a plurality of ink droplets having an identical color in each one-pixel area.

When bi-directional printing is carried out in the multilevel printer that emits a plurality of ink droplets in each one-pixel area, the hitting positions of ink droplets during the reverse pass are not aligned in the main scanning direction with those during the forward pass. This results in undesirably deteriorating the image quality.

FIG. 31 shows positional deviation of ink droplets in the main scanning direction that occur in bi-directional printing. Each lattice in FIG. 31 represents the boundary of a one-pixel area; one rectangular area defined by the lattice lines corresponds to a one-pixel area. A print head (not shown) moves in the main scanning direction and emits ink droplets to print the respective pixels. In the example of FIG. 31, odd-numbered raster lines L1, L3, and L5 are printed during the forward pass, whereas even-numbered raster lines L2 and L4 are printed during the reverse pass. The amount of ink emitted is regulated for each pixel so that one of three different dots having different sizes can be formed in the one-pixel area. A small dot is formed by emitting a relatively small ink droplet in the one-pixel area, whereas a medium dot is formed by emitting a relatively large ink droplet in the one-pixel area. A large dot is formed by emitting both of the ink droplets for forming a small dot and a medium dot in the one-pixel area. In this way, each pixel can be printed in one of four different tone levels (that is, no dot, small dot, medium dot, and large dot).

As clearly understood from FIG. 31, in the conventional bi-directional printing, the hitting positions of ink droplets during the forward pass of the main scan are different in the main scanning direction from those during the reverse pass. Relatively small ink droplets to form small dots hit on the left half of the one-pixel area in the forward pass, but hit on the right half of the one-pixel area in the reverse pass. Relatively large ink droplets to print medium dots, on the other hand, hit on the right half of the one-pixel area in the forward pass, but hit on the left half of the one-pixel area in the reverse pass. This causes a line, which is expected to extend straight in the sub-scanning direction, to be in zigzag.

As can be understood from the above example, when bi-directional printing is carried out in the conventional inkjet multilevel printer, differences in printing properties between the reverse and forward passes tends to deteriorate the image quality.

The present invention is made to solve the above problem of the prior art, and an object of the present invention is to effectively prevent deterioration of the image quality because of differences in printing properties between the reverse and forward passes in bi-directional printing in an inkjet multilevel printer.

DISCLOSURE OF THE INVENTION

In order to solve at least part of the above problems, the present invention provides a bi-directional printing technique using a printer including a print head having a plurality of nozzles and a plurality of emission driving elements for causing emission of ink droplets respectively from the plurality of nozzles, each nozzle being adaptable to form a selected one of N different dots having different sizes in one pixel area on the print medium, where N is an integer of at least 2. According to the present invention, a shape of the drive signal within each one-pixel period of main scan is modified to have N different waveforms corresponding to N different values of the print signal, the N different values of the print signal representing formation of the N different dots, while changing the N different waveforms of the drive signal between the forward pass and the reverse pass.

The change of the N different waveforms of the drive signal between the forward pass and the reverse pass effectively prevents deterioration of the image quality because the difference in printing properties between the forward pass and the reverse pass. By way of example, this arrangement will align the hitting positions of ink droplets in the main scanning direction in the forward pass and in the reverse pass. This accordingly prevents deterioration of the image quality because of a misalignment of the hitting positions of ink droplets in the main scanning direction.

The drive signal to be supplied to each of the emission driving elements may be generated by: generating an original drive signal having a plurality of pulses within the one-pixel period of main scan, the original drive signal being commonly used for the plurality of emission driving elements; generating N different masking signals corresponding to the N different values of the print signal, in order to selectively mask the plurality of pulses of the original drive signal; and selectively masking the plurality of pulses of the original drive signal with respect to each of the emission driving elements with the masking signals. In this case, waveforms of the N different masking signals corresponding to the N different values of the print signal are changed between the forward pass and the reverse pass. This arrangement will readily modify the waveform of the drive signal in the forward pass and in the reverse pass to have the N different waveforms corresponding to the different values of the print signal.

The waveform of the original drive signal within each one-pixel period of main scan may be changed between the forward pass and the reverse pass. This can modify the waveform of the original drive signal in such a manner as to absorb the difference in printing properties between the forward pass and the reverse pass. selecting one of a plurality of gradient values representing gradients of the waveform of the original drive signal;

The modification of the original drive signal may be attained by: adding the selected gradient value with a fixed period to generate level data representing a level of the original drive signal; carrying out D-A conversion of the level data to generate the original drive signal; and changing the plurality of gradient values between the forward pass and the reverse pass. This arrangement will attain the change of the original drive signal between the forward pass and the reverse pass with a relatively simple structure.

Alternatively, the drive signal waveform may be modified by: generating a plurality of drive signal pulses within each one-pixel period of main scan for emitting the plurality of ink droplets in each one-pixel area on the print medium, while reversing, within each one-pixel period of main scan, supply timing of at least one of the drive signal pulses in the one-pixel period to emit ink droplets, to the emission driving element between the forward pass and the reverse pass. The reversing of the drive signal pulses between the forward and reverse passes will align the hitting positions of ink droplets in the main scanning direction in the forward pass and those in the reverse pass. This effectively prevents deterioration of the image quality because of misalignment of the hitting positions of ink droplets in the main scanning direction.

The drive signal pulses may be generated responsive to a bit-sequence modified signal, which is produced by reversing bit positions in the multi-bit print signal between the forward pass and the reverse pass, thereby producing a bit-sequence modified signal. When the drive signal pulses are reversed between the forward pass and the reverse pass, ink droplets of suitable for recording pixels can be emitted responsive to the bit-sequence modified signal.

The plurality of drive signal pulses may be generated responsive to the bit-sequence modified signal. In this case, the plurality of drive signal pulses are generated as pulses having different waveforms, which are used to emit ink droplets having different amounts of ink, corresponding to the N different values of the print signal. A plurality of tone levels can be expressed in one pixel by emitting or non-emitting a plurality of ink droplets having different amounts of ink. The above arrangement also prevents deterioration of the image quality because misalignment of the hitting positions of ink droplets in the main scanning direction.

Furthermore, a plurality of original drive signal pulses having different waveforms may be generated in each one-pixel period of main scan while reversing generation timings of the plurality of original drive signal pulses within each one-pixel period of main scan between the forward pass and the reverse pass. In this case, the drive signal pulses used for recording each pixel may be generated by masking the plurality of original drive signal pulses with the bit-sequence modified signal.

Alternatively, the drive signal pulses used for recording each pixel may be produced by: generating a plurality of original drive signal pulses having a substantially identical waveform within each one-pixel period of main scan, in order to cause a plurality of ink droplets having a substantially fixed amount of ink to be emitted within each one-pixel period of main scan; and masking the plurality of original drive signal pulses with the bit-sequence modified signal.

The present invention can be embodied in various forms such as a printing method, a printing apparatus, a computer program that has the functions of the method or of the apparatus, a computer readable medium on which is recorded the computer program, and a data signal embodied in a carrier wave comprising the computer program.

BRIEF DESCRIPTION OF THE DRAWINGS

FIGS. 14(*a*) and 14(*b*) show a comparison between dots recorded in the second embodiment and dots recorded by the conventional bi-directional printing;

FIG. 20 illustrates the contents of waveform data stored in ROM 310 of an original drive signal generation control circuit 302;

FIGS. 26(A) and 26(B) show truth tables used in the masking signal generating circuit 334 to obtain a masking signals MSK in the fourth embodiment;

FIGS. 27(*a*), 27(*b*-1), 27(*b*-2), 27(*c*-1), 27(*c*-2), 27(*d*-1), 27(*d*-2), 27(*e*-1) and 27(*e*-2) are timing charts showing waveforms of the drive signal and the masking signal in the forward pass in a fifth embodiment;

FIGS. 28(*a*), 28(*b*-1), 28(*b*-2), 28(*c*-1), 28(*c*-2), 28(*d*-1), 28(*d*-2), 28(*e*-1) and 28(*e*-2) are timing charts showing waveforms of the drive signal and the masking signal in the reverse pass in the fifth embodiment;

FIGS. 29(A) and 29(B) show truth tables used in the masking signal generating circuit 334 to obtain the masking signals MSK in the fifth embodiment;

FIGS. 30(A) and 30(B) show truth tables used in the masking signal generating circuit 334 to obtain the masking signals MSK in a sixth embodiment; and, FIG. 31 shows positional deviation of ink droplets that occur in the course of bi-directional printing in a conventional inkjet multilevel printer

BEST MODES FOR CARRYING OUT THE INVENTION

A. Structure of Apparatus

Figure 1:
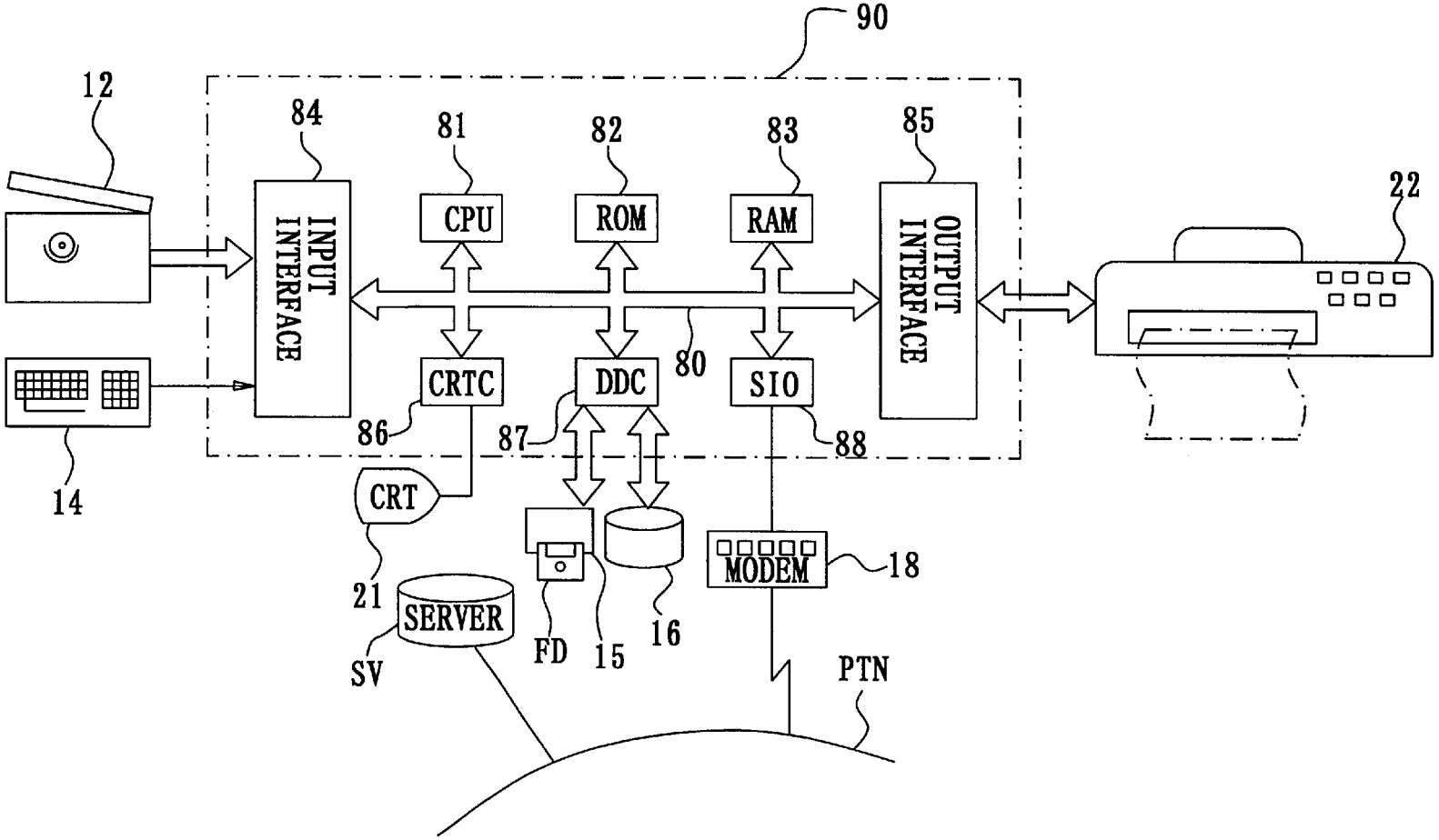
FIG. 1 schematically illustrates the structure of a printing apparatus embodying the present invention.

FIG. 1 is a block diagram illustrating the structure of a printing apparatus as a first embodiment of the present invention. As illustrated in FIG. 1, a computer 90 is connected with a scanner 12 and a color printer 22. The system acts as a printing apparatus when the computer 90 executes computer programs loaded therein. The printer 22 by itself can be called "printing apparatus in a narrow sense," while the printing apparatus composed of the computer 90 and the printer 22 can be called "printing apparatus in a broad sense." In the following description, the phrase "printing apparatus" means the "printing apparatus in the narrow sense."

The computer 90 includes CPU 81 and other peripheral units mutually connected to one another via a bus 80. The CPU 81 executes a variety of arithmetic and logic operations according to computer programs in order to control operations related to image processing. ROM 82 stores computer programs and data required for execution of the variety of arithmetic and logic operations by the CPU 81. RAM 83 is a memory, which temporarily stores various computer programs and data required for execution of the variety of arithmetic and logic operations by the CPU 81. An input interface 84 receives input signals from the scanner 12 and a keyboard 14, whereas an output interface 85 sends output data to the printer 22. CRT controller (CRTC) 86 controls signal outputs to CRT 21 that can display color images. A disk drive controller (DDC) 87 controls transmission of data from and to a hard disk 16, a flexible drive 15, and a CD-ROM drive (not shown). The hard disk 16 stores a variety of computer programs that are loaded into the RAM 83 and executed, as well as other computer programs that are supplied in the form of device drivers.

A serial input-output interface (SIO) 88 is also connected to the bus 80. The SIO 88 is connected to a public telephone network PTN via a modem 18. The computer 90 is connected with an external network via the SIO 88 and the modem 18, and can access a specific server SV in order to download computer programs into the hard disk 16. The computer 90 may alternatively execute computer programs which have been loaded from a flexible disk FD or a CD-ROM.

Figure 2:
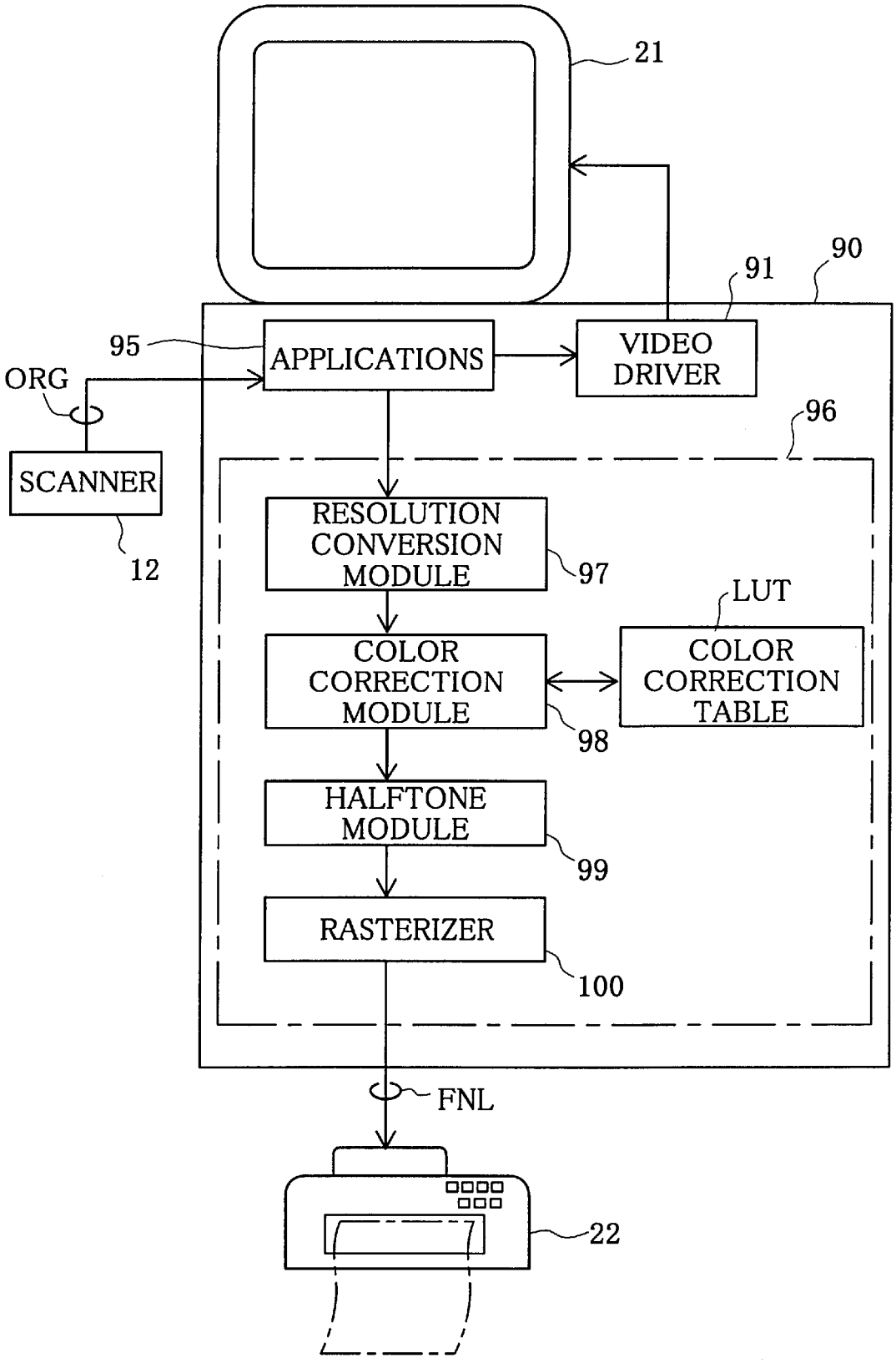
FIG. 2 shows the software configuration.

FIG. 2 is a block diagram conceptually illustrating the software configuration of the printing apparatus. In the computer 90, an applications program 95 is activated under a specific operating system. The operating system includes a video driver 91 and a printer driver 96. The printer driver 96 processes image data supplied from the applications program 95 and outputs final color image data FNL to the printer 22. The applications program 95 used to, for example, retouch an image, reads an image from the scanner 12 and executes predetermined processing on the input image, while displaying the image on the CRT display 21 via the video driver 91. The data ORG supplied from the scanner 12 is an original color image data ORG including red(R), green(G), and blue(B) components, which are captured from a color original.

When the applications program 95 outputs a printing instruction, the printer driver 96 receives image information from the applications program 95 and converts the input image information to signals suitable for the printer 22: the signals here are multilevel signals for cyan, light cyan, magenta, light magenta, yellow, and black. In the example of FIG. 2, the printer driver 96 includes a resolution conversion module 97, a color correction module 98, a color correction table LUT, a halftone module 99, and a rasterizer 100.

The resolution conversion module 97 converts a resolution of the color image data, the number of pixels in each unit length, processed by the applications program 95 into another resolution suitable for the printer driver 96. The image data after the resolution conversion is image information composed of RGB components. The color correction module 98 converts the image data into data for cyan (C), light cyan (LC), magenta (M), light magenta (LM), yellow (Y), and black (K) used in the printer 22, with respect to each pixel. with reference to the color correction table. The data after the color correction has multi tone levels, for example, 256 levels. The halftone module performs halftoning process to determine the multi tone levels of distributed dots formed by the printer 22. The data thus processed is rearranged by the rasterizer 100 in order of data transfer to the printer 22, and is output as the final printing image data FNL. In this embodiment, the printer 22 only forms dots responsive to the printing image data FNL, and does not perform image processing.

Figure 3:
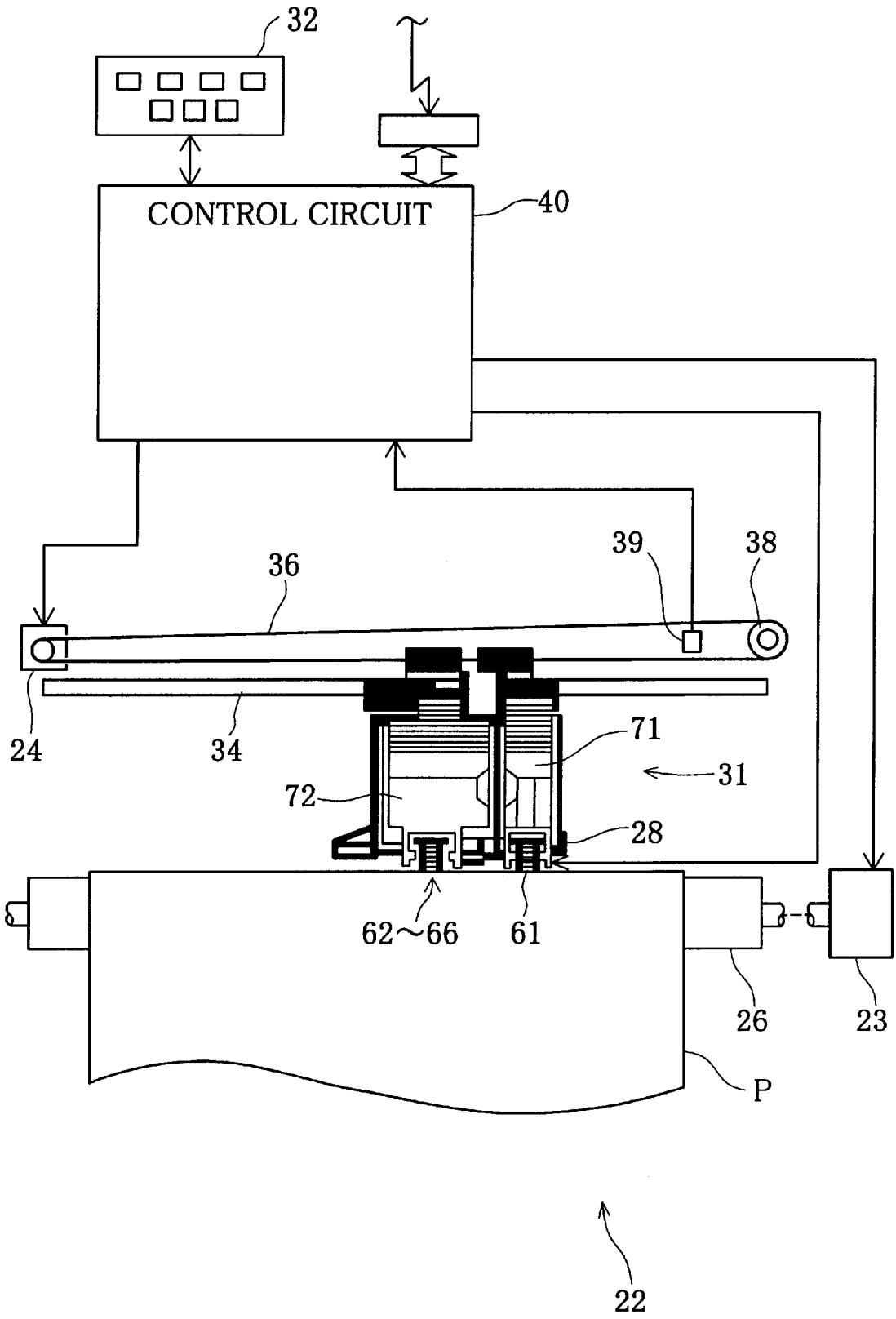
FIG. 3 schematically illustrates the structure of a printer in the embodiment.

FIG. 3 schematically illustrates the structure of the printer 22. The printer 22 has a mechanism for feeding a sheet of paper P by means of a sheet feed motor 23, a mechanism for reciprocating a carriage 31 along the axis of a platen 26 by means of a carriage motor 24, a mechanism for driving a print head 28 mounted on the carriage 31 to control discharge of ink and formation of dots, and a control circuit 40 for transmitting signals to and from the sheet feed motor 23, the carriage motor 24, the print head 28, and a control panel 32.

The mechanism for reciprocating a carriage 31 along the axis of a platen 26 includes: a slide axis, disposed in parallel to the axis of the platen 26, for slidably supporting the carriage 31; a pulley 38 between which and the carriage motor 24 is provided an endless drive belt 36; and a position detection sensor 39 for detecting the origin of the carriage 31.

A black ink cartridge 71 and a color ink cartridge 72 for cyan (C1), light cyan (C2), magenta (M1), light magenta (M2), and yellow (Y) can be mounted on the carriage 31. There are provided light and dark inks for cyan and magenta. Six ink discharge heads 61–66 are formed on the print head 28 that is disposed in the lower portion of the carriage 31, and ink supply conduits 67 (see FIG. 4) are formed in the bottom portion of the carriage 31 for leading supplies of ink from ink tanks to the respective ink discharge heads 61–66. When the black ink cartridge 71 and the color ink cartridge 72 are attached downward to the carriage 31, the ink supply conduits 67 are inserted into connection apertures (not shown) formed in the respective cartridges. This enables supplies of ink to be fed from the respective ink cartridges to the ink discharge heads 61–66.

Figure 4:
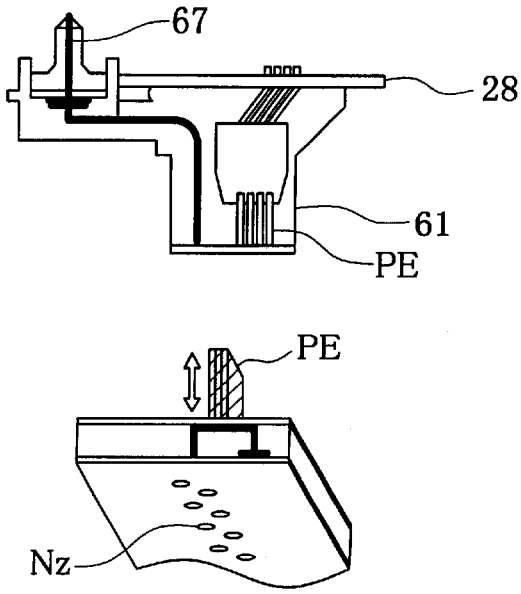
FIG. 4 schematically illustrates the structure of a print head in the printer of the embodiment.

The following briefly describes the mechanism of discharging ink and dot formation. FIG. 4 schematically illustrates the internal structure of the ink discharge head 28. When the ink cartridges 71 and 72 are attached to the carriage 31, ink in the ink cartridges 71 and 72 are sucked out through the ink supply conduits 67 and are led to the ink discharge heads 61–66 formed in the print head 28 arranged in the lower portion of the carriage 31 as shown in FIG. 4. When the ink cartridges 71 and 72 are attached to the carriage 31, a pump works to suck first supplies of ink into the respective ink discharge heads 61–66. In this embodiment, the structures of the pump for suction and a cap for covering the print head 28 during the suction are not illustrated nor described specifically.

Figure 5:
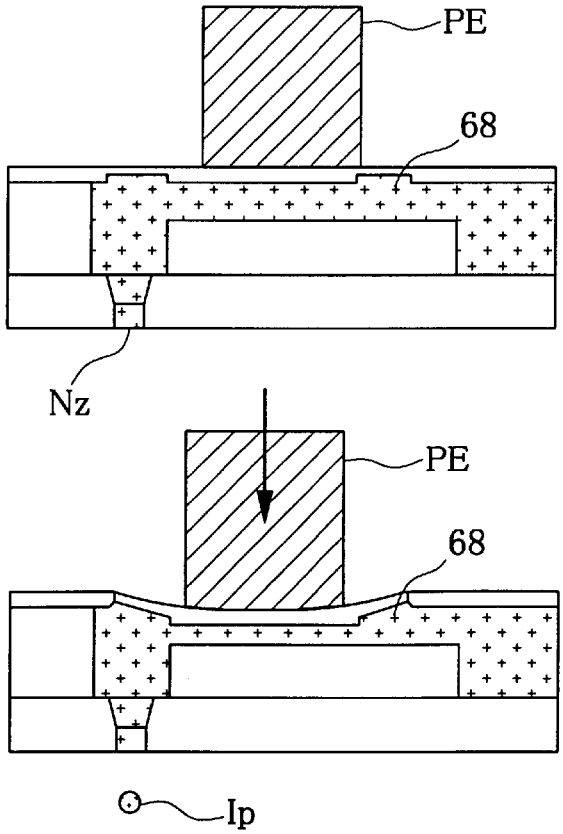
FIG. 5 shows the principle of dot formation in the printer of the embodiment.
Figure 6:
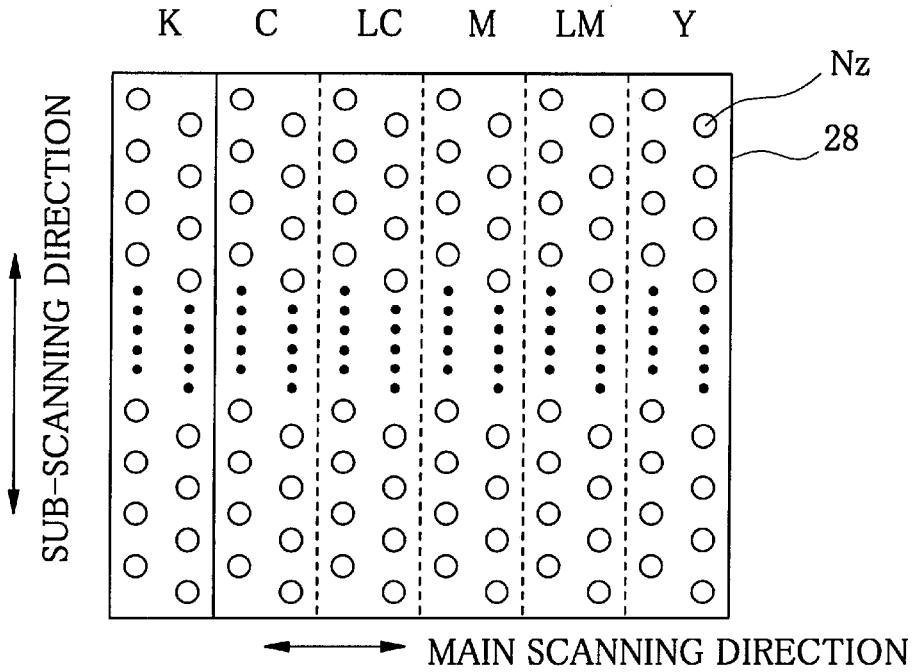
FIG. 6 shows a nozzle arrangement available in the printer of the embodiment.

An array of forty-eight nozzles Nz is formed in each of the ink discharge heads 61–66 as shown in FIG. 6. A piezoelectric element PE, which is one of electrically distorting elements and has an excellent response, is provided for each nozzle Nz. FIG. 5 illustrates a configuration of the piezoelectric element PE and the nozzle Nz. The piezoelectric element PE is disposed at a position that comes into contact with an ink conduit 68 for leading ink to the nozzle Nz. As is known, the piezoelectric element PE has a crystal structure that is subjected to a mechanical stress due to application of a voltage and thereby carries out extremely high-speed conversion of electrical energy to mechanical energy. In this embodiment, application of a voltage between electrodes on either ends of the piezoelectric element PE for a predetermined time period causes the piezoelectric element PE to extend for the predetermined time period and deform one side wall of the ink conduit 68 as shown in the lower part of FIG. 5. The volume of the ink conduit 68 is reduced with an extension of the piezoelectric element PE, and a certain amount of ink corresponding to the reduced volume is sprayed as ink particles Ip from the ends of the nozzle Nz at a high speed. The ink particles Ip soak into the sheet of paper P set on the platen 26, so as to reproduce a print.

FIG. 6 shows an arrangement of inkjet nozzles in the ink discharge heads 61–66. This arrangement includes six nozzle arrays for respective colors, and each array is composed of forty-eight nozzles Nz arranged in zigzag with a constant nozzle pitch k in the sub-scanning direction. The nozzle arrays are put at the same position in the sub-scanning direction. The forty-eight nozzle Nz included in each nozzle array may be arranged in alignment, instead of in zigzag. The zigzag arrangement as shown in FIG. 6, however, has the advantage of being able to set a smaller nozzle pitch k in the manufacturing process.

Figure 7:
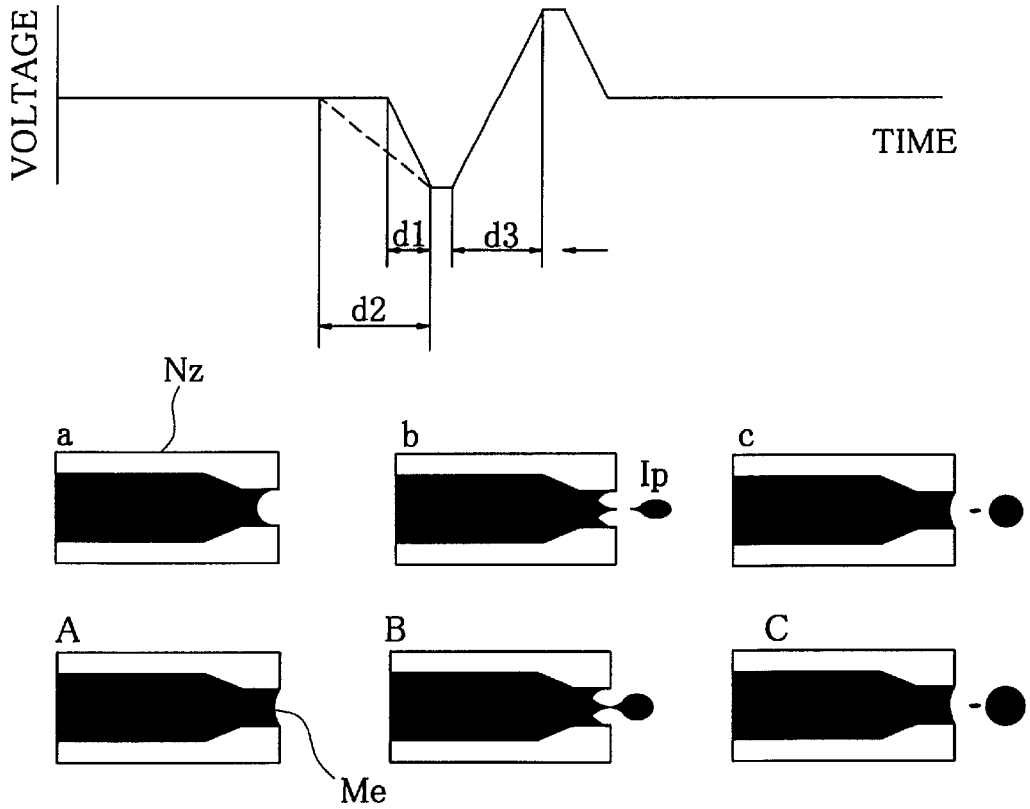
FIG. 7 shows enlarged views of nozzle configuration and their relation with dots to be formed.

The printer 22 has the nozzles Nz of a fixed diameter as shown in FIG. 6 and can create three different types of dots having different diameters with these nozzles Nz. The following describes the principle of such dot formation technique. FIG. 7 shows the relationship between the drive signal waveform of the nozzle Nz and the size of the ink particle Ip emitted from the nozzle Nz. The drive signal waveform shown by the broken line in FIG. 7 is used to form standard-sized dots. Application of a negative voltage to the piezoelectric element PE in an interval d2 deforms the piezoelectric element PE in the direction of increasing the cross section of the ink conduit 68, contrary to the case of FIG. 5. As shown in a state A of FIG. 7, an ink interface Me, which is generally referred to as meniscus, is thus slightly depressed inward the nozzle Nz. When the drive signal waveform shown by the solid line in FIG. 7 is used to abruptly apply a negative voltage in an interval d1, on the other hand, the meniscus is more significantly depressed inward as shown in a state 'a', compared with the state A. Subsequent application of a positive voltage to the piezoelectric element PE in an interval d3 causes ink to be emitted, based on the principle described previously with the drawing of FIG. 5. As shown in states B and C, a large ink droplet is emitted when the meniscus is only slightly depressed inward (state A). As shown in states 'b' and 'c', on the other hand, a small ink droplet is emitted when the meniscus is significantly depressed inward (state 'a').

Figure 8:
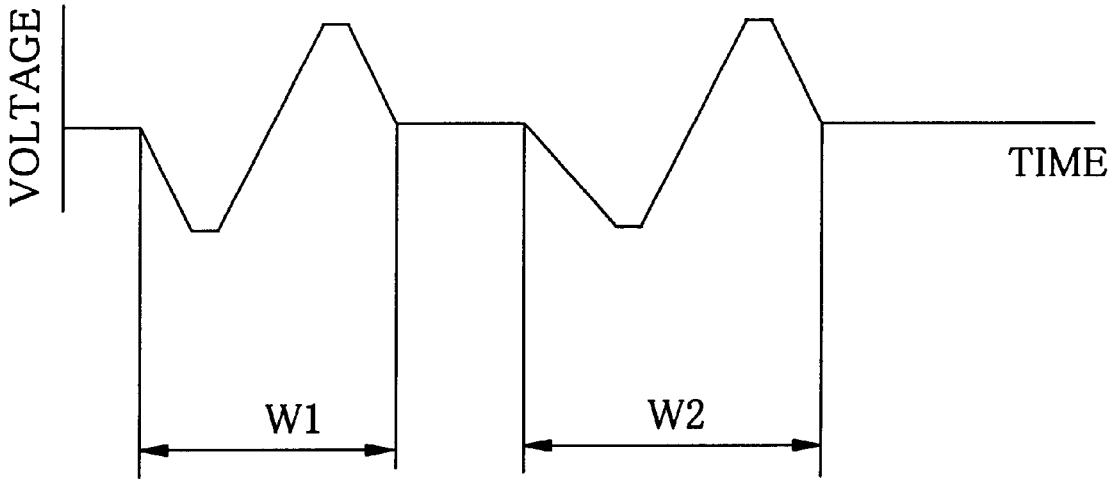
FIG. 8 shows the principle of forming dots of various sizes.

As discussed above, the dot diameter can be varied according to the change rate of the drive signal in the intervals d1 and d2 where the driving voltage is negative. It is readily expected that the dot diameter can also be varied with a variation in peak voltage of the drive signal waveform. This embodiment provides two different drive signal waveforms, that is, one for forming small dots of a small diameter and the other for forming medium dots of an intermediate diameter, based on the relationship between the drive signal waveform and the dot diameter. FIG. 8 shows drive signal waveforms used in this embodiment. A drive signal waveform W1 is used to form small dots (small dot pulse), whereas a drive signal waveform W2 is used to form medium dots (medium dot pulse). When both the small dot pulse W1 and the medium dot pulse W2 are successively generated within the time period of main scan for one pixel as shown in FIG. 8, ink droplets for the small and medium dots hit the area of one identical pixel to form a large dot.

In the printer 22 having the hardware structure discussed above, while the sheet feed motor 23 feeds the printing paper P (hereinafter referred to as the sub-scan), the carriage motor 24 moves the carriage 31 in forward and reverse passes (hereinafter referred to as the main scan), simultaneously with actuation of the piezoelectric elements PE on the respective print heads 61–66 of the print head 28. The printer 22 accordingly emits the respective color inks to form dots and thereby reproduce a multi-color image on the printing paper P.

In this embodiment, the printer 22 has the head that uses the piezoelectric elements PE to emit ink as discussed previously. A variety of elements other than the piezoelectric elements may, however, be used for the emission driving elements. The invention is, for example, applicable to the printer with emission driving elements that supplies electricity to a heater, installed in an ink conduit, to cause bubbles in the ink conduit to emit ink.

B. First Embodiment

Figure 9:
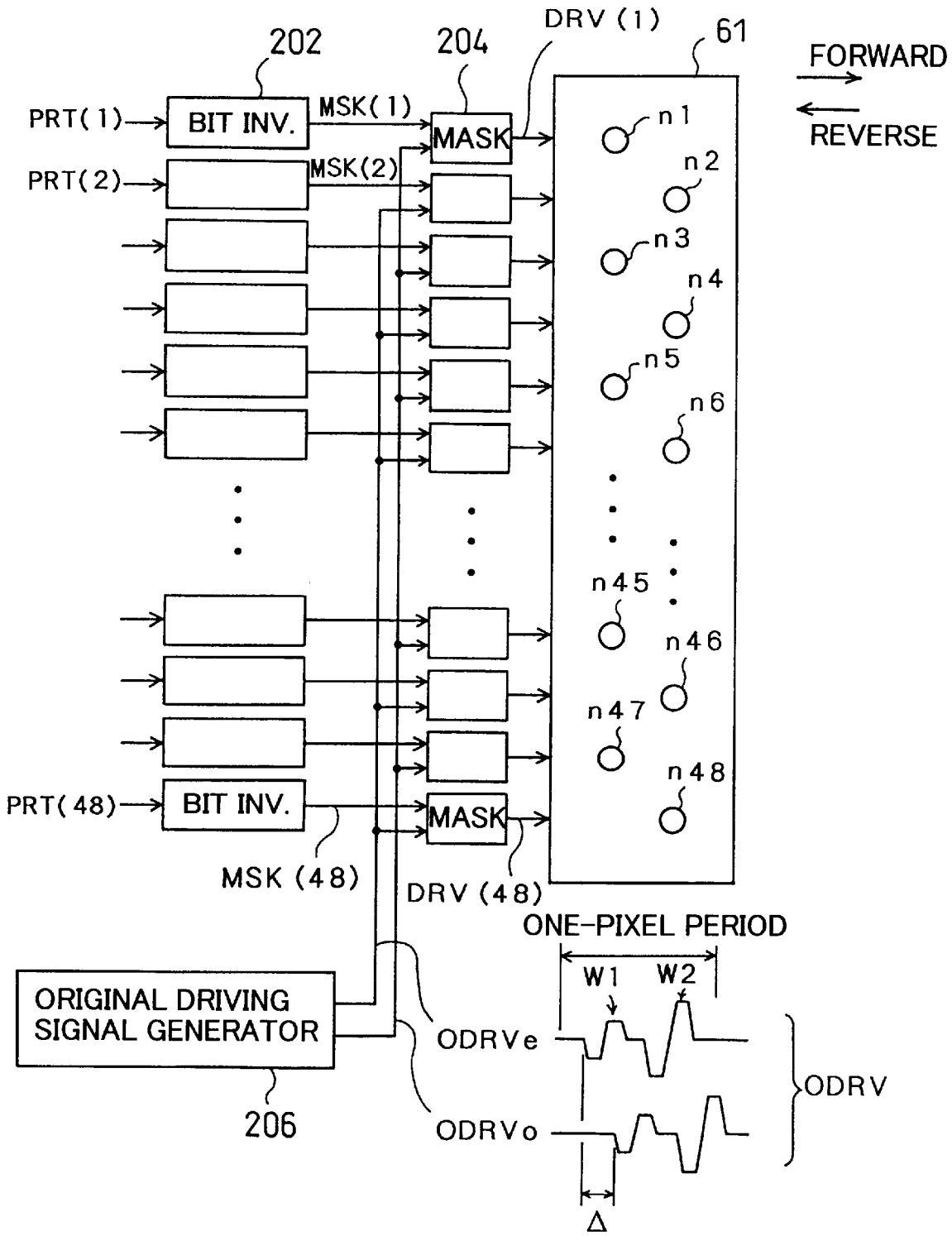
FIG. 9 is a block diagram illustrating the structure of a drive signal generator in a first embodiment of the present invention.

FIG. 9 is a block diagram illustrating the structure of a drive signal generator included in the control circuit 40 (FIG. 3) in a first embodiment of the present invention. The drive signal generator includes a plurality of bit inversion circuits 202, a plurality of masking circuits 204, and an original drive signal generator 206. The bit inversion circuits 202 and the masking circuits 204 are provided corresponding to a plurality of piezoelectric elements for driving nozzles n1–n48 mounted on the print head 61. The numerals in the brackets added to the respective signal names in FIG. 9 represent the nozzle numbers to which the corresponding signals are supplied.

The original drive signal generator 206 generates an original drive signal ODRVo used in common for odd-numbered nozzles n1, n3, . . . , n47 and another original drive signal ODRVe used in common for even-numbered nozzles n2, n4, . . . , n48. Each of these two original drive signals ODRVo and ODRVe includes two pulses, that is, the small dot pulse W1 and the medium dot pulse W2, within the time period of main scan for one pixel. In the forward pass, the original drive signal ODRVo for the odd-numbered nozzles is delayed by a fixed time period Δ from the original drive signal ODRVe for the even-numbered nozzles. Since the odd-numbered nozzles follows the even-numbered nozzles in the course of the forward pass (rightward in FIG. 9), the delayed emission of ink droplets from the odd-numbered nozzles by the fixed time period Δ enables pixels to be printed at an identical position in the main scanning direction. In the reverse pass, on the contrary, the original drive signal ODRVe for the even-numbered nozzles is delayed by the fixed time period Δ from the original drive signal ODRVo for the odd-numbered nozzles. In the reverse pass, the timings of generating the small dot pulse W1 and the medium dot pulse W2 are reversed as discussed later.

The generation of the drive signal for the odd-numbered nozzles is essentially the same as the generation of the drive signal for the even-numbered nozzles. In the description below, they are not specifically distinguished from each other.

The bit inversion circuit 202 outputs an input serial print signal PRT(i) in the forward pass, while outputs an inversion of the serial print signal PRT(i) in the reverse pass. The serial print signal PRT(i) represents the recording state of each pixel recorded in one main scan by the i-th nozzle. The signal PRT(i) for each nozzle is derived from the print image data FNL (see FIG. 2), which is supplied from the computer 90.

Figure 10:
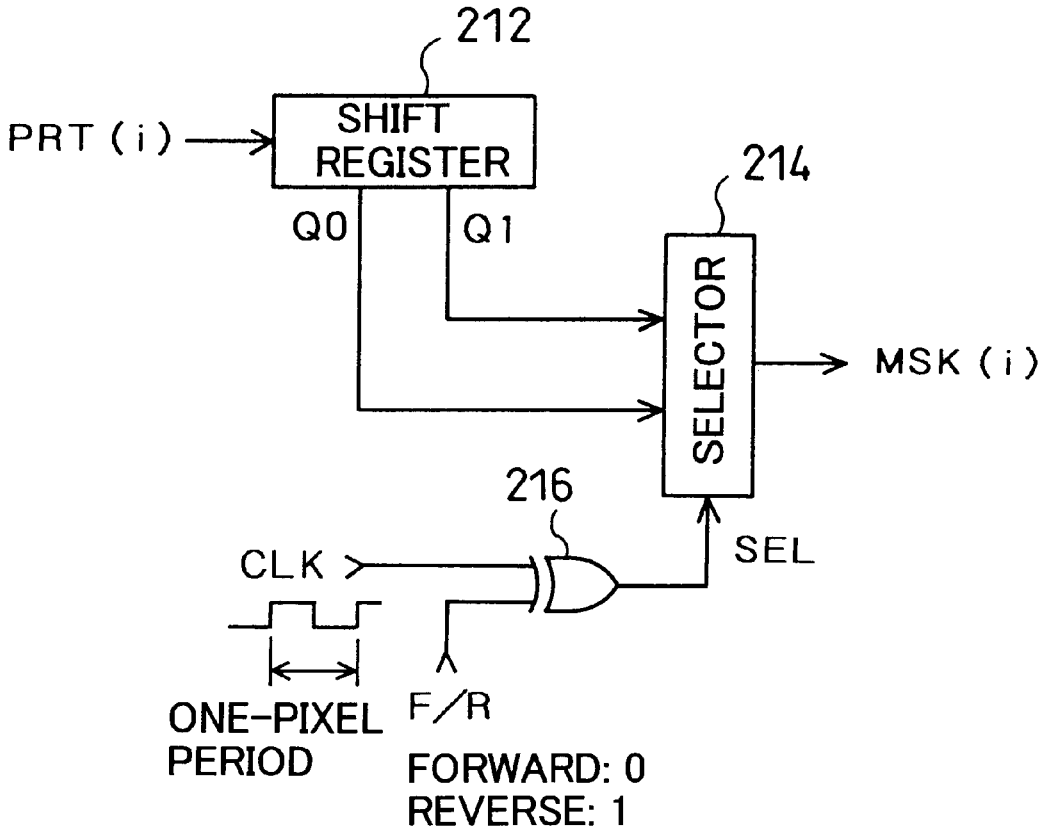
FIG. 10 is a block diagram illustrating the internal structure of a bit inversion circuit 202.

FIG. 10 is a block diagram illustrating an exemplified internal structure of the bit inversion circuit 202. The bit inversion circuit 202 includes a shift register 212, a selector 214, and an EXOR circuit 216. The shift register 212 converts the serial print signal PRT(i) into a 2-bit parallel signal and supplies the 2-bit parallel signal to the selector 214. The selector 214 successively selects one of two bits Q0 and Q1 supplied from the shift register 212, in response to a selection signal SEL output from the EXOR circuit 216.

The EXOR circuit 216 receives a clock signal CLK and a forward/reverse signal F/R input therein and makes an exclusive OR of these signals to generate the selection signal SEL. The clock signal CLK has the level '1' in the former half of one pixel and the level '0' in the latter half. The forward/reverse signal F/R has the level '0' in the forward pass and the level '1' in the reverse pass. The clock signal CLK is accordingly output as the selection signal SEL in the forward pass, whereas the inversion of the clock signal CLK is output as the selection signal SEL in the reverse pass.

The selector 214 successively selects one of the two bits Q0 and Q1 in response to the selection signal SEL within the time period of main scan for each pixel and outputs the selected bit as a masking signal MSK(i). In the forward pass, the two bits are output as the masking signal MSK(i) in the same order as that of the serial print signal PRT(i) (that is, in order of Q1 and Q0). In the reverse pass, on the other hand, the two bits are output as the masking signal MSK(i) in the reverse order of the serial print signal PRT(i) (that is, in order of Q0 and Q1).

Referring to FIG. 9, the masking signal MSK(i) output from the bit inversion circuit 202 is input together with the original drive signal ODRV output from the original drive signal generator 206 into the masking circuit 204. The masking circuit 204 is a gate that masks the original drive signal ODRV responsive to the level of the masking signal MSK(i). The masking circuit 204 supplies the original drive signal ODRV as a drive signal DRV to the piezoelectric element when the masking signal MSK(i) has the level '1', while the masking circuit 204 cuts the original drive signal ODRV off when the masking signal MSK(i) has the level '0'.

Figure 11:
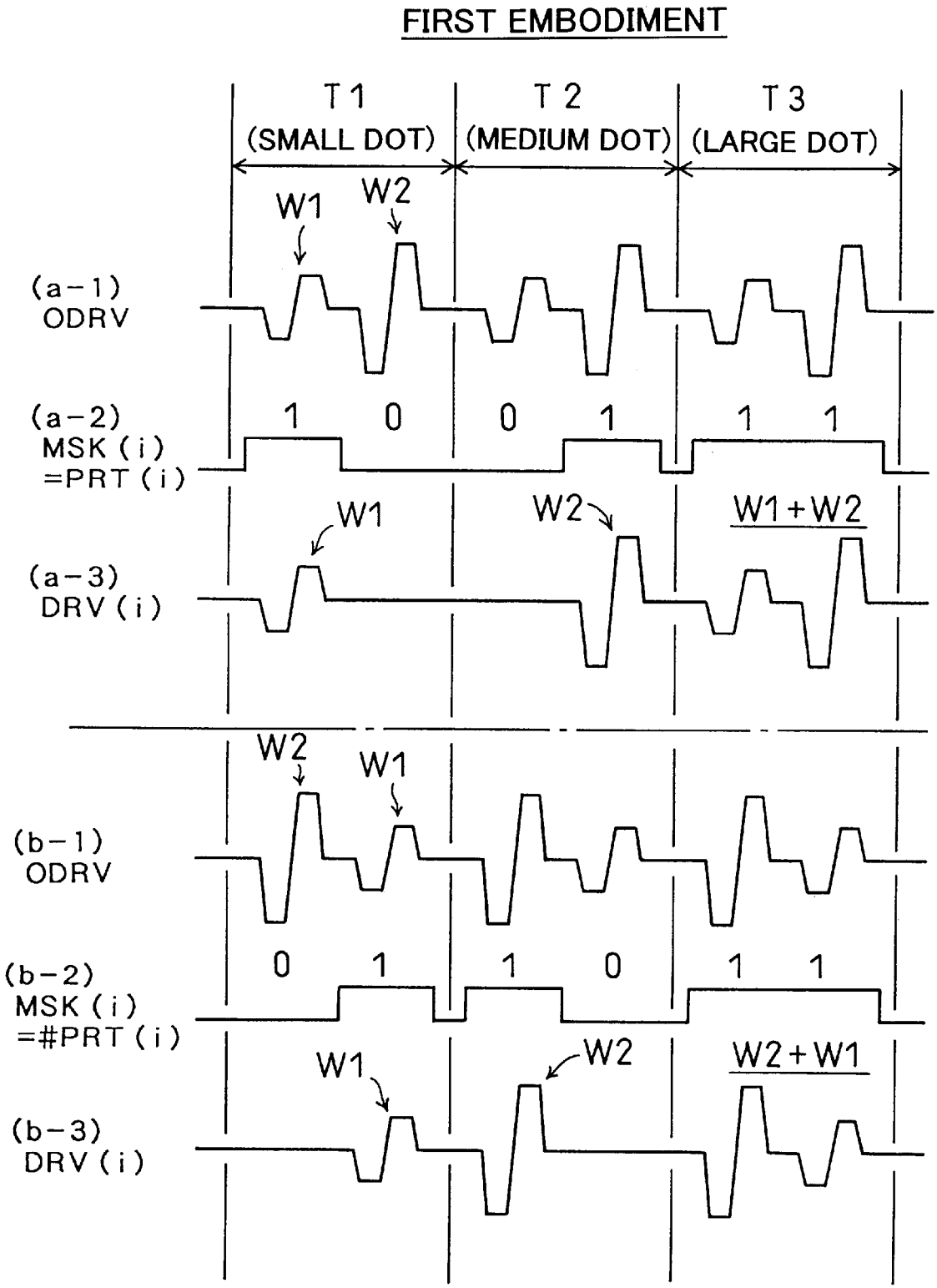
FIGS. 11(*a*-1)–11(*a*-3) and 11(*b*-1)–11(*b*-3) are timing charts showing operations of the drive signal generator in the first embodiment.

FIGS. 11(*a*-1)–11(*a*-3) and 11(*b*-1)–11(*b*-3) are timing charts showing operation of the drive signal generator shown in FIG. 9. FIGS. 11(*a*-1)–11(*a*-3) show the signal waveforms in the forward pass, whereas FIGS. 11(*b*-1)–11(*b*-3) show the signal waveforms in the reverse pass.

In the forward pass, the small dot pulse W1 and the medium dot pulse W2 are generated in this order as the pulses of the original drive signal ODRV in one-pixel periods T1, T2, and T3 as shown in FIG. 11(*a*-1). The term 'one-pixel period' means the time period of main scan for one pixel. The masking signal MSK(i) shown in FIG. 11(*a*-2) is a 2-bit serial signal per pixel, where the respective bits correspond to the small dot pulse W1 and the medium dot pulse W2. As discussed previously, the masking circuit 204 (FIG. 9) allows transmission of the pulses of the original drive signal ODRV when the masking signal MSK(i) has the level '1', and forbids transmission of the pulses of the original drive signal ODRV when the masking signal MSK (i) has the level '0'. If the two bits of the masking signal MSK(i) are '1,0' in the one-pixel period, only the small dot pulse W1 is output as a drive signal DRV(i) in the former half of the one-pixel period (T1) as shown in FIG. 11(*a*-3). If the two bits are '0,1', only the medium dot pulse W2 is output as the drive signal DRV(i) in the latter half of the one-pixel period (T2). If the two bits are '1,1', both the small dot pulse W1 and the medium dot pulse W2 are output as the drive signal DRV(i) in the one-pixel period (T3).

In the reverse pass, on the other hand, the medium dot pulse W2 and the small dot pulse W1 are generated in this order, that is, in the order reverse to that in the forward pass, as the pulses of the original drive signal ODRV in the respective one-pixel periods T1, T2, and T3 as shown in FIG. 11(*b*-1). The positions of the respective bits included in the masking signal MSK(i) are also reversed respectively correspond to the order of the medium dot pulse W2 and the small dot pulse W1 as shown in FIG. 11(*b*-2). The symbol '#PRN(i)' shown in FIG. 11(*b*-2) represents a signal having the bit positions (that is, the bit order) reverse to those of the serial print signal PRN(i). Referring to FIG. 11(*b*-3), the pulses of the drive signal DRV(i) in the respective one-pixel periods T1, T2, and T3 in the reverse pass are accordingly generated at timings reverse to those in the forward pass.

Figure 12:
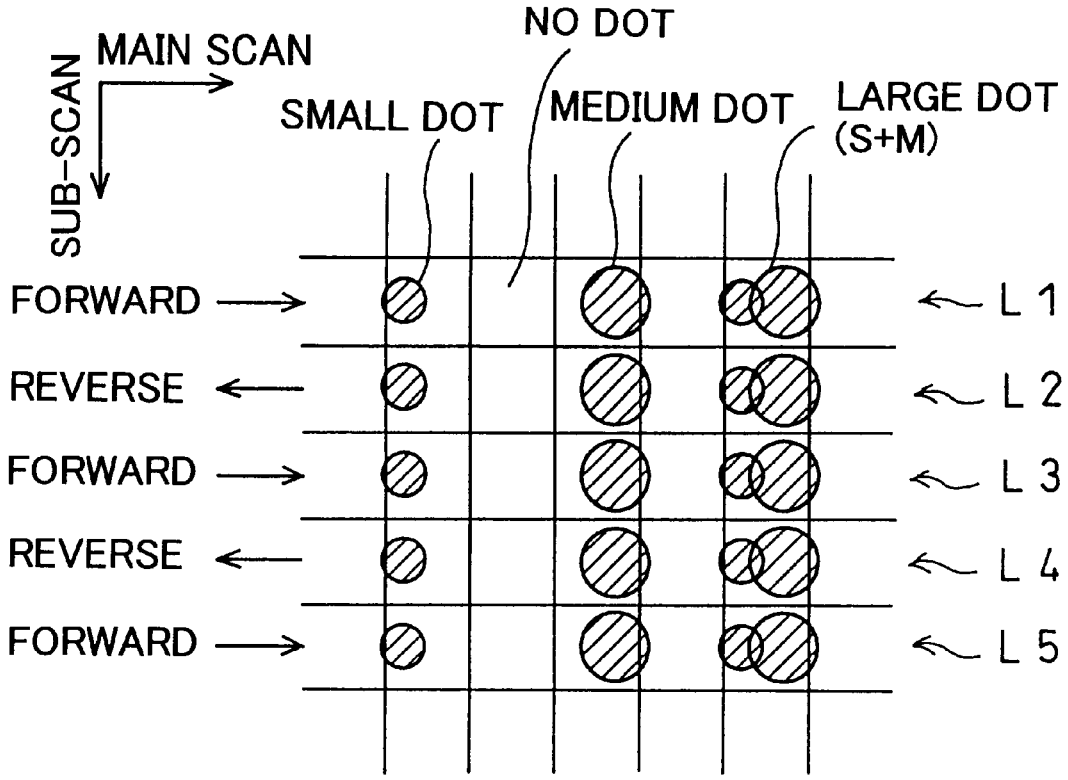
FIG. 12 shows dots recorded in the first embodiment.

FIG. 12 shows dots printed in response to the drive signals DRV(i) of FIGS. 11(*a*-3) and 11(*b*-3). In the forward pass, the small dot pulse W1 is generated in the former half of the one-pixel period as shown in FIG. 11(*a*-3), and a small dot is formed on the left side in each one-pixel area accordingly. The medium dot pulse W2 is generated in the latter half of the one-pixel period, and a medium dot is formed on the right side in each one-pixel area accordingly. A large dot is formed by making ink droplets for the small dot and the medium dot partly overlap each other. In the reverse pass, on the other hand, the small dot pulse W1 is generated in the latter half of the one-pixel period, but a small dot is formed on the left side in each one-pixel area in the same manner as in the forward pass because the print head moves in a reverse way to that in the forward pass,. The medium dot pulse W2 is generated in the former half of the one-pixel period, and a medium dot is formed on the right side in each one-pixel area in the same manner as in the forward pass. In the example of FIG. 12, for the clarity of illustration, pixels with no dots are interposed between the pixels with small dots and those with medium dots and between the pixels with medium dots and those with large dots.

As discussed above, the first embodiment makes the hitting positions of ink droplets in the main scanning direction in the respective one-pixel areas in the forward pass to be substantially aligned with, that is, substantially coincident with, those in the reverse pass, with respect to all three of the small dot, the medium dot, and the large dot. This prevents a straight line extending in the sub-scanning direction from being a zigzag line. This arrangement effectively prevents deterioration of the image quality because positional deviation of ink droplets in the main scanning direction in bi-directional printing.

C. Second Embodiment

Figure 13:
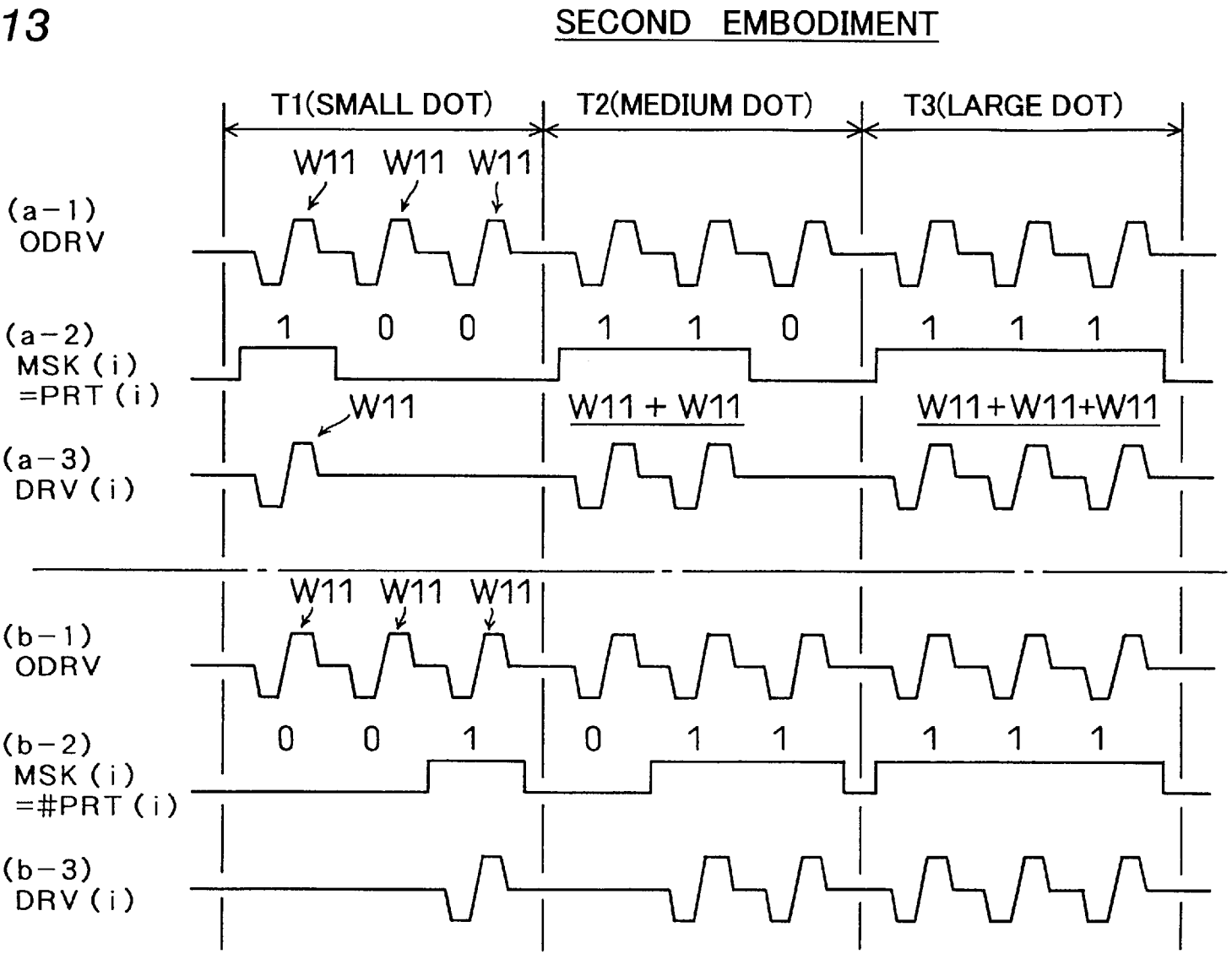
FIGS. 13(*a*-1)–13(*a*-3) and 13(*b*-1)–13(*b*-3) are timing charts showing operation of another drive signal generator in a second embodiment of the present invention.

FIGS. 13(*a*-1)–13(*a*-3) and 13(*b*-1)–13(*b*-3) are timing charts showing operation of another drive signal generator in a second embodiment of the present invention. FIGS. 13(*a*-1)–13(*a*-3) show signal waveforms in the forward pass, whereas FIGS. 13(*b*-1)–13(*b*-3) show signal waveforms in the reverse pass. The drive signal generator of the second embodiment is substantially similar to that of the first embodiment shown in FIG. 9, except that the bit inversion circuit 202 reverses the positions of three bits because the serial print signal includes three bits in the one-pixel period in the second embodiment.

In the forward pass, three small dot pulses W1 of an identical waveform are generated as the pulses of the original drive signal ODRV in one-pixel periods T1, T2, and T3 as shown in FIG. 13(*a*-1). The masking signal MSK(i) and the serial print signal PRT(i) also include three bits in each one-pixel period as shown in FIG. 13(*a*-2). The original drive signal ODRV is masked with the masking signal MSK(i) and supplied as the drive signal DRV(i) to the piezoelectric element corresponding to an i-th nozzle (see FIG. 13(*a*-3)). If the three bits of the masking signal MSK(i) are '1,0,0' in the one-pixel period, only one small dot pulse W1 is output as the drive signal DRV(i) in the first one third of the one-pixel period as shown in FIG. 13(*a*-3). If the three bits are '1,1,0', two small dot pulses W1 are output as the drive signal DRV(i) in the former two thirds of the one-pixel period. If the three bits are '1,1,1', three small dot pulses W1 are output as the drive signal DRV(i) in the one-pixel period.

In the reverse pass, three small dot pulses W1 of the identical waveform are also generated as the pulses of the original drive signal ODRV in the respective one-pixel periods T1, T2, and T3 as shown in FIG. 13(*b*-1). The positions of the respective bits in the masking signal MSK(i) are inverted to be reverse to those in the forward pass as shown in FIG. 13(*b*-2). Referring to FIG. 13(*b*-3), the pulses of the drive signal DRV(i) in the respective one-pixel periods T1, T2, and T3 in the reverse pass are accordingly generated at timings reverse to those in the forward pass. In the pixels where large dots are to be formed, three small dot pulses W1 of the identical waveform are generated both in the forward pass and the reverse pass, and reversing the timings of generating the three pulses does not substantially change the signal waveform.

FIGS. 14(*a*) and 14(*b*) show a comparison between dots recorded in the second embodiment and dots recorded by conventional bi-directional printing. In the second embodiment shown in FIG. 14(*a*), when small dots are to be formed in the forward pass, one small dot pulse W1 is generated in the first one third of the one-pixel period as shown in FIG. 13(*a*-3), and a small dot is formed at the position of one third on the left in each one-pixel area accordingly. When medium dots are to be formed, two small dot pulses W1 are generated in the former two thirds of the one-pixel period, and a medium dot is formed at the position of two thirds on the left in each one-pixel area. When large dots are to be formed, three small dot pulses W1 are generated substantially uniformly over the one-pixel period, and a large dot is formed to cover the whole one-pixel area. In the second embodiment, the pitch of the one-pixel areas (that is, the rectangular areas defined by lattices) in the main scanning direction is approximately twice the pitch in the sub-scanning direction.

When small dots are to be formed in the reverse pass, on the other hand, one small dot pulse W1 is generated in the last one third of the one-pixel period as shown in FIG. 13(*b*-3). Since the print head moves in a reverse way to that in the forward pass, a small dot is formed at the position of one third on the left in each one-pixel area in the same manner as in the forward pass. When medium dots are to be formed, two small dot pulses W1 are generated in the latter two thirds of the one-pixel period, and a medium dot is formed at the position of two thirds on the left in each one-pixel area as in the forward pass. The second embodiment thus effectively prevents straight lines extending in the sub-scanning direction from being zigzag lines.

FIG. 14(*b*) shows results of conventional bi-directional printing. In the conventional bi-directional printing, the pulses of the drive signal DRV are generated at the same timings in the forward and reverse passes. This deforms straight lines formed of small dots and those formed of medium dots, extending in the sub-scanning direction, to become zigzag lines.

Like the first embodiment discussed above, the second embodiment makes the hitting positions of ink droplets in the main scanning direction in the respective one-pixel areas in the forward pass to be substantially aligned with those in the reverse pass, with respect to all the three of the small dot, the medium dot, and the large dot. This prevents straight lines extending in the sub-scanning direction from being zigzag lines. This arrangement effectively prevents deterioration of the image quality because of positional deviation of ink droplets in the main scanning direction in bi-directional printing.

As clearly understood from the first and the second embodiments, the plurality of ink droplets emitted in the one-pixel period may have different amounts of ink or an identical amount of ink. The present invention is thus generally applicable to the structure that emits a plurality of ink droplets from one nozzle to form a dot in each one-pixel area.

D. Third Embodiment

Figure 15:
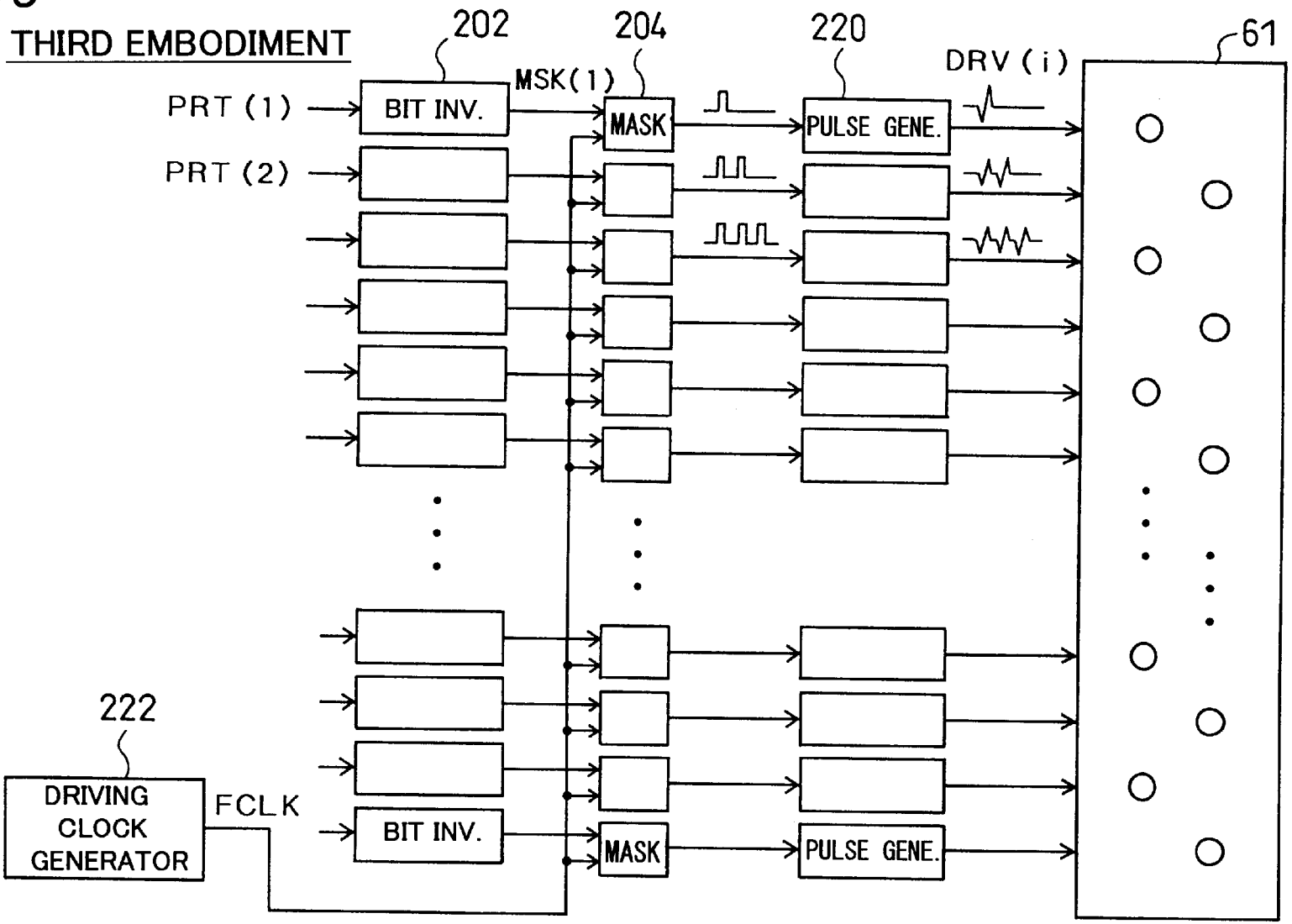
FIG. 15 is a block diagram illustrating the structure of still another drive signal generation in a third embodiment of the present invention.

FIG. 15 is a block diagram illustrating the structure of still another drive signal generator in a third embodiment of the present invention. The drive signal generator has pulse generator circuits 220, which are interposed between the masking circuits 204 and the print head 61 (that is, the piezoelectric elements) in the drive signal generator of the first embodiment shown in FIG. 9, and a driving clock generator 222 in place of the original drive signal generator 206 of FIG. 9.

Figure 16:
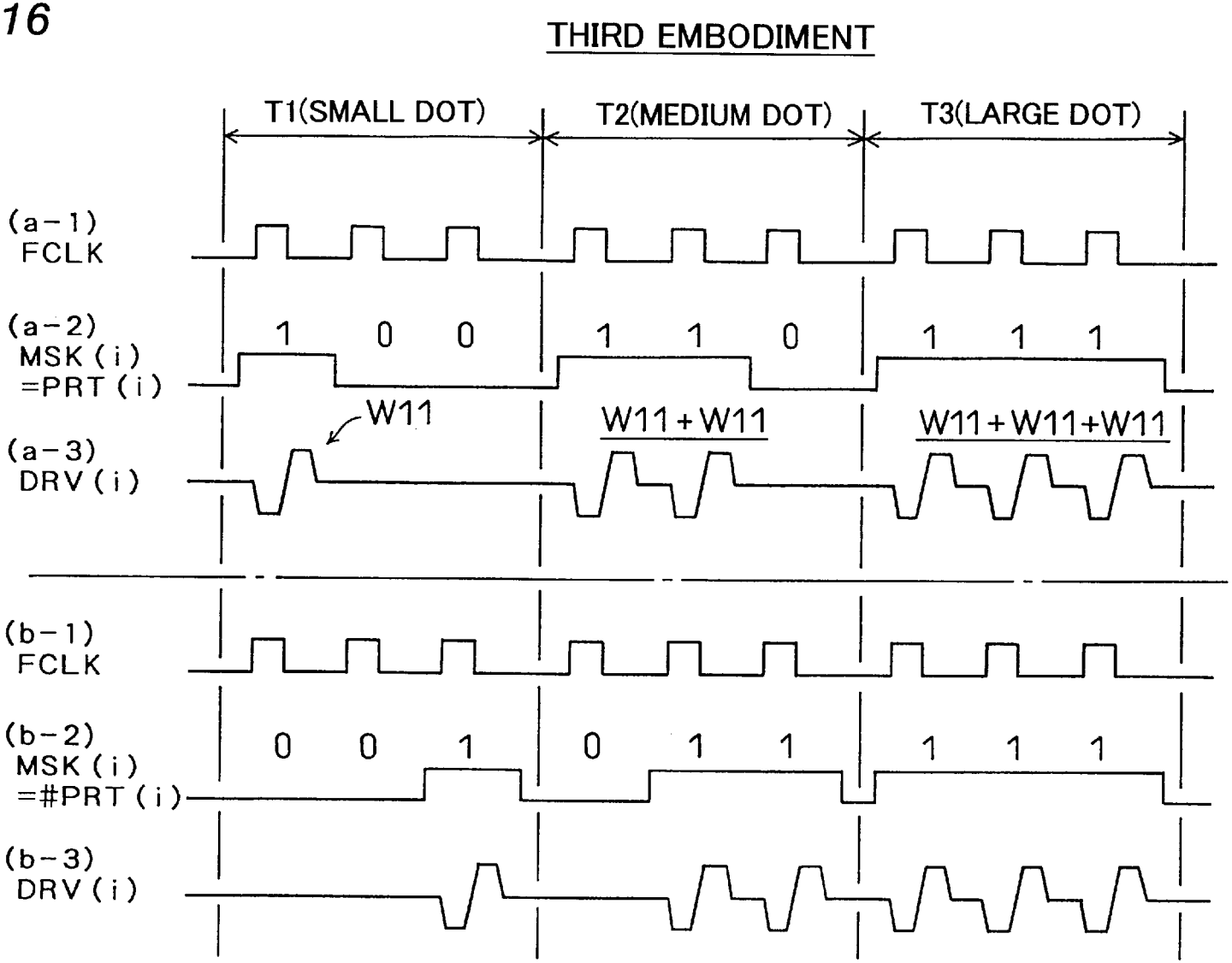
FIGS. 16(*a*-1)–16(*a*-3) and 16(*b*-1)–16(*b*-3) are timing charts showing operation of the drive signal generator in the third embodiment.

FIGS. 16(*a*-1)–16(*a*-3) and 16(*b*-1)–16(b-3) are timing charts showing operation of the drive signal generator shown in FIG. 15. FIGS. 16(*a*-1)–16(*a*-3) show signal waveforms in the forward pass, whereas FIGS. 16(*b*-1)–16(*b*-3) show signal waveforms in the reverse pass. The masking signal MSK(i) and the drive signal DRV(i) in the third embodiment have the same waveforms as those of the masking signal MSK(i) and the drive signal DRV(i) in the second embodiment shown in FIGS. 13(*a*-2) and 13(*a*-3). The only difference between the third embodiment and the second embodiment is the concrete circuit structure for generating the drive signals DRV(i).

The driving clock generator 222 generates a driving clock signal FCLK shown in FIG. 16(*a*-1). The driving clock signal FCLK includes three clock pulses in each one-pixel period. The three clock pulses in each one-pixel period are masked with the masking signal MSK(i) by the masking circuit 204. Only the clock pulses at which the masking signal MSK(i) has the level '1' pass through the masking circuits 204 and are supplied to the pulse generator circuits 220. The pulse generator circuit 220 is triggered by the input clock pulse to generate the small dot pulse W1. This results in generating the drive signals DRV(i) as shown in FIGS. 16(*a*-3) and 16(*b*-3). Namely the arrangement of the third embodiment effects dots formation in the same manner as the second embodiment.

E. Fourth Embodiment

Figure 17:
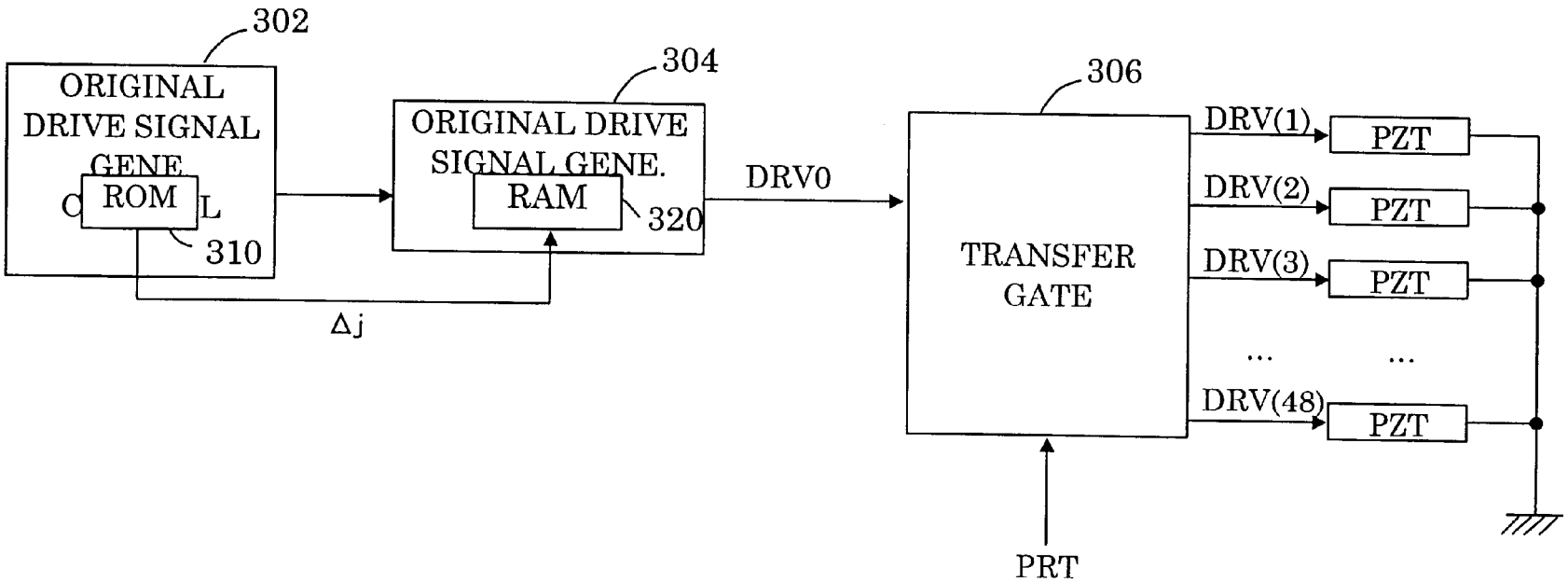
FIG. 17 is a block diagram illustrating the structure of the drive signal generator in a fourth embodiment.

FIG. 17 is a block diagram illustrating the structure of the drive signal generator in a fourth embodiment. The drive signal generator includes an original drive signal generation control circuit 302, an original drive signal generation circuit 304, and a transfer gate 306.

The original drive signal generating circuit 304 has RAM 320 for storing gradient values Δj representing gradients of the waveform of an original drive signal DRV0, and generates the original drive signal DRV0 having an arbitrary waveform using the gradient value Δj. The structure and the operation of the original drive signal generating circuit 304 will be described later. The original drive signal generation control circuit 302 has ROM 310 (or PROM) which stores a plurality of gradient values Δj for the forward pass and for the reverse pass. The transfer gate 306 masks part or all the original drive signal DRV0 responsive to the value of the serial print signal PRT supplied from the computer 90 (see FIG. 2), and generates and supplies a drive signal DRV to the piezoelectric elements of the respective nozzles. The structure and the operation of the transfer gate 306 will be described later.

Figure 18:
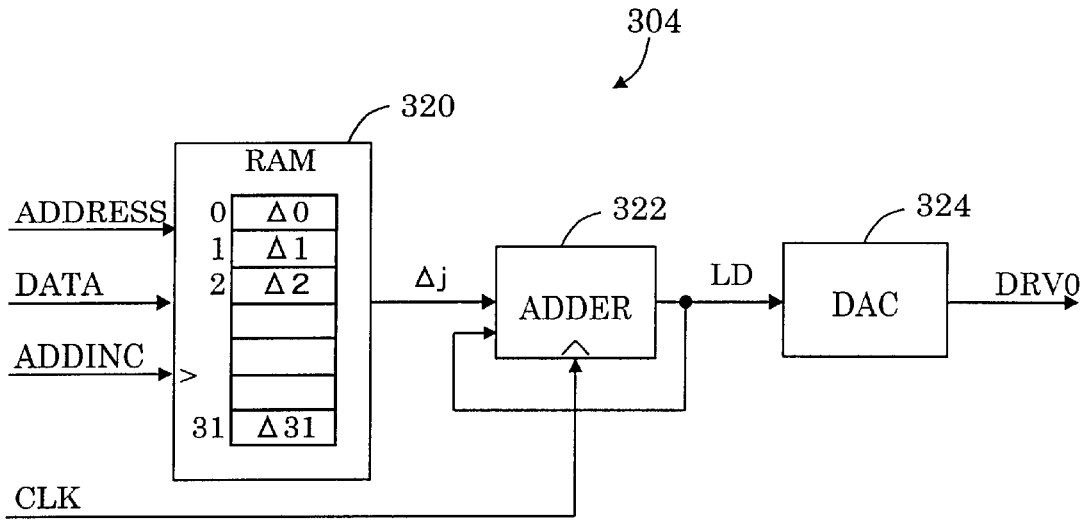
FIG. 18 is a block diagram illustrating the internal structure of an original drive signal generating circuit 304.

FIG. 18 is a block diagram illustrating the internal structure of the original drive signal generation circuit 304. The original drive signal generating circuit 304 has an adder 322 and D-A converter 324 other than the RAM 320. The RAM 320 can store 32 gradient values Δ0–Δ31. When gradient values Δj are written into the RAM 320, data representing the gradient values Δj and their addresses are supplied from the original drive signal generation control circuit 302 to the RAM 320. When a gradient value Δj is read from the RAM 320, on the other hand, an address increment signal ADDINC is supplied from the original drive signal generation control circuit 302 to an address increment terminal of the RAM 320, while a clock signal CLK of a constant period is supplied from the original drive signal generation control circuit 302 to a clock terminal of the adder 322.

The adder 322 successively adds the gradient values Δj read from the RAM 320 at every cycle of the clock signal CLK and thereby generates original drive signal level data LD. The D-A converter 324 carries out D-A conversion of this level data LD to generate the original drive signal DRV0.

Figure 19:
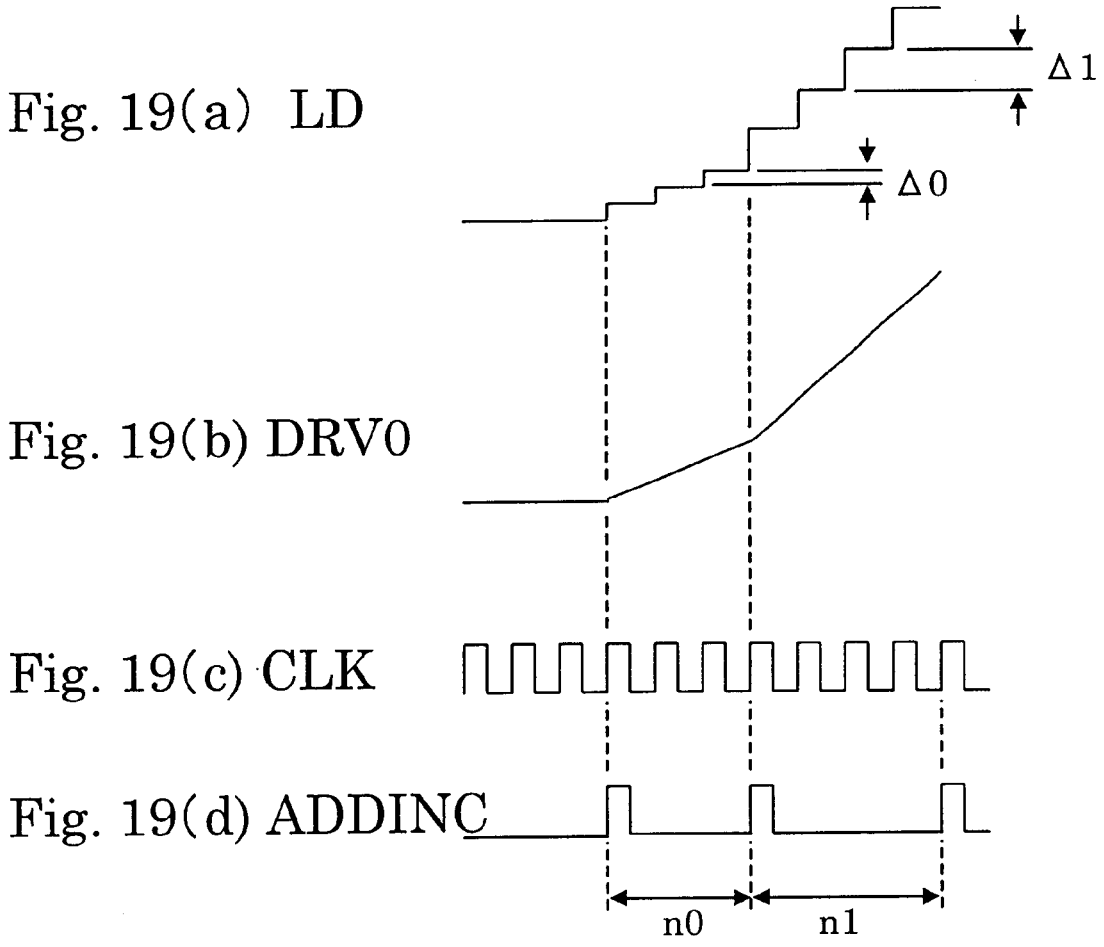
FIGS. 19(*a*)–19(*d*) are timing charts showing generation of the original drive signal DRV0 by the original drive signal generating circuit 304.

FIGS. 19(*a*)–19(*d*) are timing charts showing generation of the original drive signal DRV0 by the original drive signal generating circuit 304. When a first pulse of the address increment signal ADDINC (FIG. 19(*e*)) is supplied to the RAM 320, the first gradient value Δ0 is read from the RAM 320 and input into the adder 322. The first gradient value Δ0 is repeatedly added at every rising edge of the clock signal CLK to generate the level data LD until a next pulse of the address increment signal ADDINC is supplied. When a next pulse of the address increment signal ADDINC is supplied to the RAM 320, the second gradient value Δ1 is read from the RAM 320 and input into the adder 322. Namely the address increment signal ADDINC occurs one pulse when the number of pulses of the clock signal CLK becomes equal to the number of times of addition nj (j=0 to 31) for each gradient value Δj. The gradient value Δj equal to zero makes the level of the original drive signal DRV0 to keep constant. The negative gradient value Δj decreases the level of the original drive signal DRV0. The original drive signal DRV0 having an arbitrary waveform can be thus generated by setting the gradient value Δj and the number of times of addition nj.

FIG. 20 illustrates the contents of waveform data stored in the ROM 310 of the original drive signal generation control circuit 302. The ROM 310 stores waveform data which include a plurality of the gradient values Δj and the number of times of addition nj with respect to the forward and reverse passes. The original drive signal generation control circuit 302 writes a plurality of gradient values Δj used for a next forward pass or a next reverse pass into the RAM 320 of the original drive signal generating circuit 304 during the interval between forward and reverse passes (that is, while the carriage 31 leaves the printable area and is present at either end of the printer 22). The number of times of addition n0 is utilized for generation of the address increment signal ADDINC in the original drive signal generation control circuit 302. The original drive signal DRV0 having an arbitrary waveform can be generated respectively in the forward and reverse passes using the original drive signal generating circuit 304 shown in FIGS. 18–20.

Figure 21:
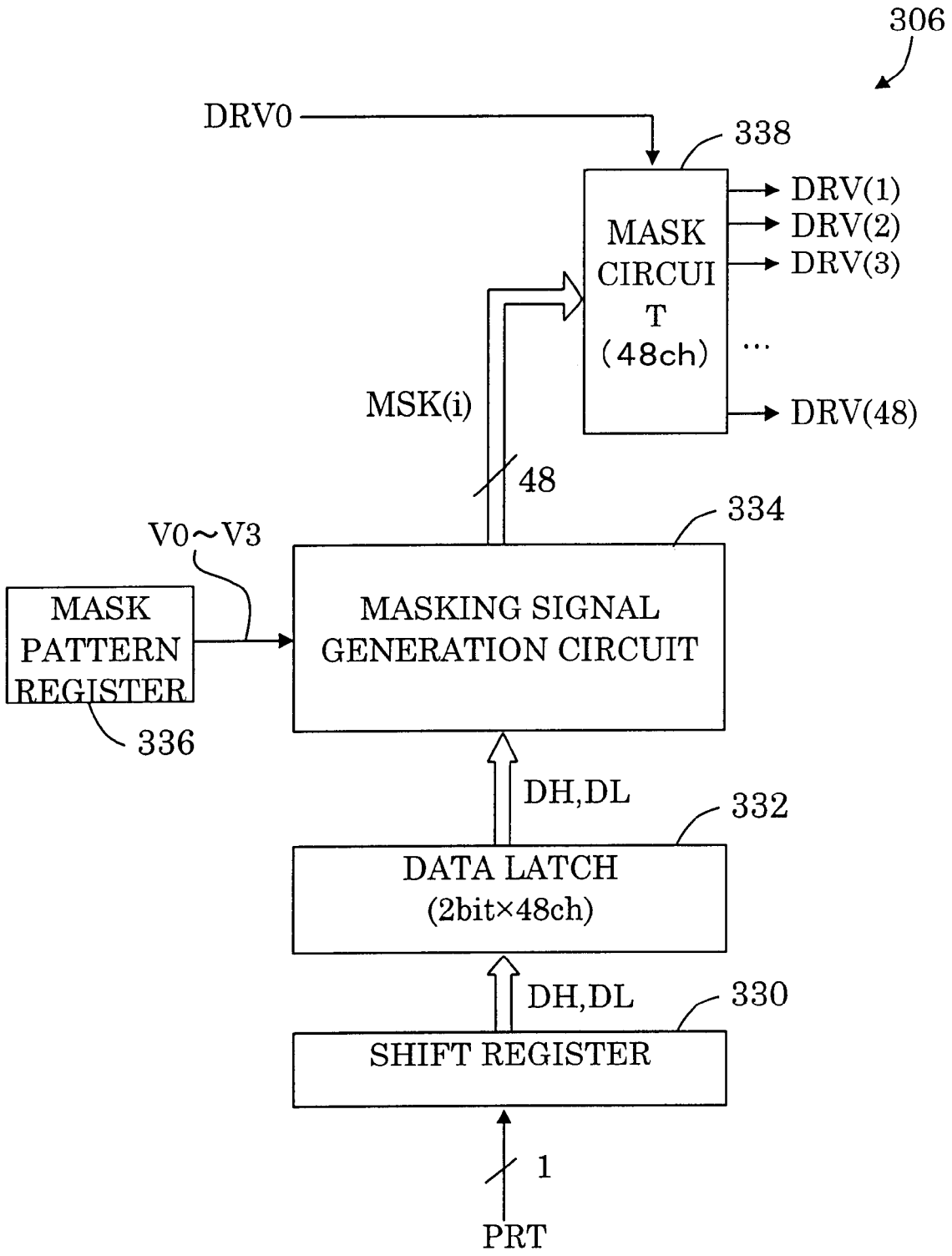
FIG. 21 is a block diagram illustrating the internal structure of a transfer gate 306.

FIG. 21 is a block diagram illustrating the internal structure of the transfer gate 306. The transfer gate 306 includes a shift register 330, a data latch 332, a masking signal generation circuit 334, a mask pattern register 336, and a masking circuit 338. The shift register 330 converts the serial print signal PRT supplied from the computer 90 into 48 channels of 2-bit parallel data. Here 'channel' means a signal for one nozzle. The print signal PRT with regard to one pixel for one nozzle is two-bit data including an upper bit DH and a lower bit DL. The masking signal generation circuit 334 generates a 1-bit masking signal MSK(i) (i=1 to 48) for each channel in response to mask pattern data V0–V3 supplied from the mask pattern register 336 and the 2-bit print signal PRT(DH,DL) for each channel. The structure and the operation of the masking signal generation circuit 334 will be described later. The masking circuit 338 is a switching circuit that masks part or all the signal waveform in one pixel period of the original drive signal DRV0 in response to the given masking signal MSK(i).

Figure 22:
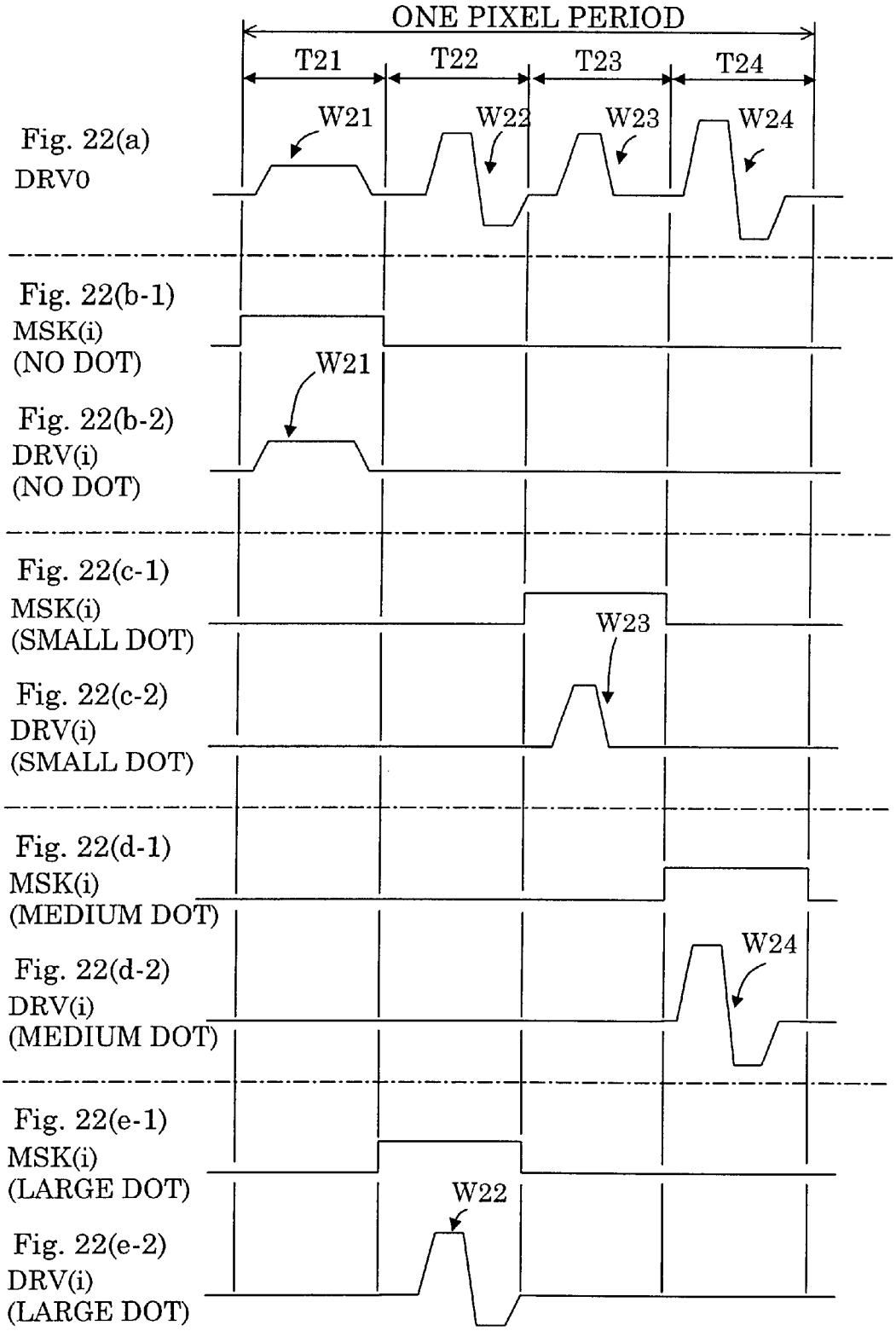
FIGS. 22(*a*), 22(*b*-1), 22(*b*-2), 22(*c*-1), 22(*c*-2), 22(*d*-1), 22(*d*-2), 22(*e*-1) and 22(*e*-2) are timing charts showing waveforms of the drive signal and the masking signal during the forward pass in the fourth embodiment.

FIGS. 22(*a*), 22(*b*-1), 22(*b*-2), 22(*c*-1), 22(*c*-2), 22(*d*-1), 22(*d*-2), 22(*e*-1) and 22(*e*-2) are timing charts showing waveforms of the drive signal and the masking signal in the forward pass in the fourth embodiment. As shown in FIG. 22(*a*), in the forward pass, the original drive signal DRV0 has four different pulses W21–W24 generated respectively in four partial periods T–T24 in one pixel period. The four periods T21–T24 may be set to have arbitrary lengths, respectively. As shown in FIGS. 22(*b*-1) and 22(*b*-2), when no dot is recorded in one pixel area, the masking signal MSK(i) masks all the pulses other than the first pulse W21 to generate a drive signal DRV(i). Generation of the pulse W21 in the case of non-dot-forming facilitates ejection of ink at a next ejection timing (at the position of a next pixel to be recorded). The masking signal MSK(i) masks all the pulses other than the third pulse W23 to record a small dot, masks all the pulses other than the fourth pulse W24 to record a medium dot, and masks all the pulses other than the second pulse W22 to record a large dot.

Figure 23:
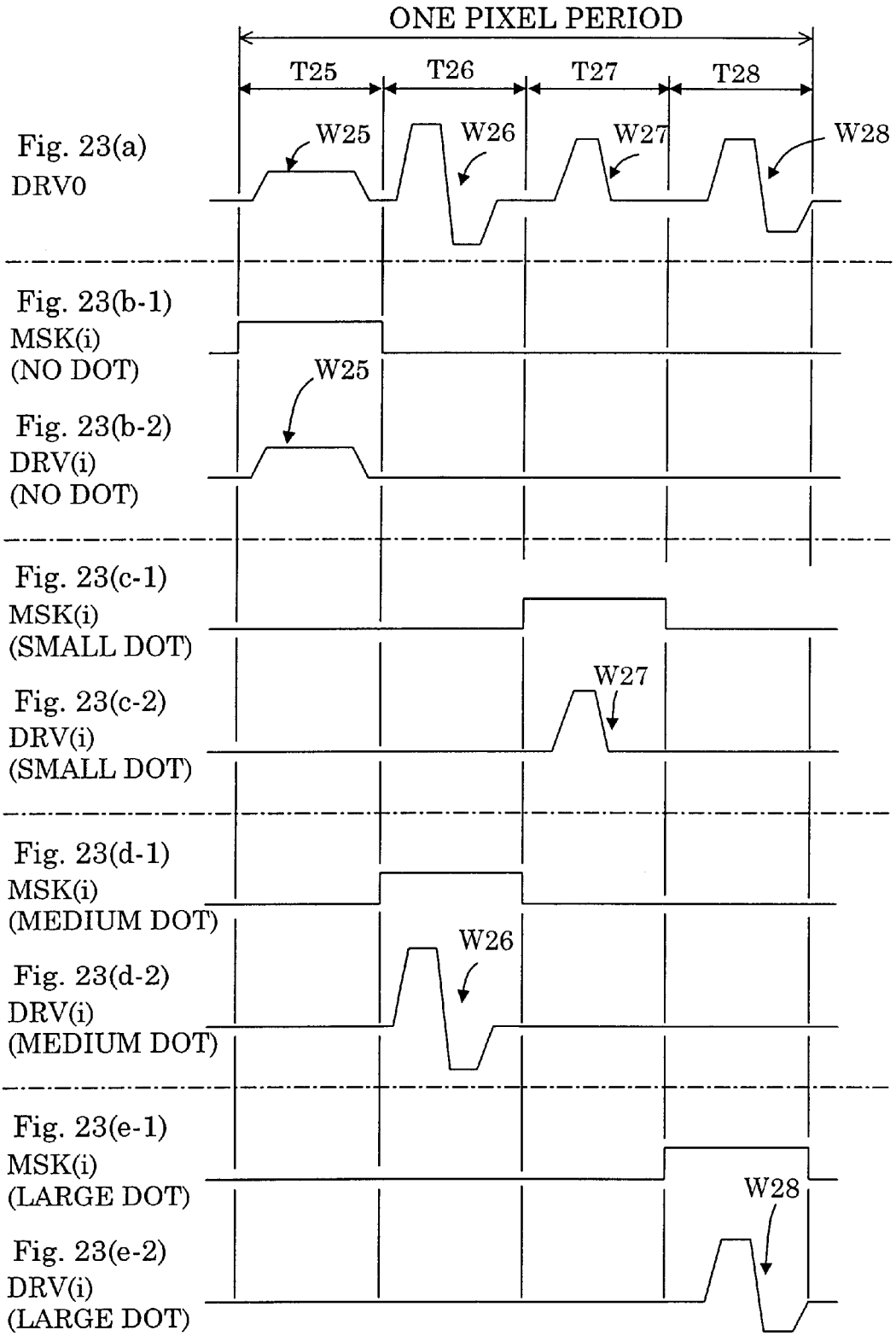
FIGS. 23(*a*), 23(*b*-1), 23(*b*-2), 23(*c*-1), 23(*c*-2), 23(*d*-1), 23(*d*-2), 23(*e*-1) and 23(*e*-2) are timing charts showing waveforms of the drive signal and the masking signal during the forward pass in the fourth embodiment.

FIGS. 23(*a*), 23(*b*-1), 23(*b*-2), 23(*c*-1), 23(*c*-2), 23(*d*-1), 23(*d*-2), 23(*e*-1) and 23(*e*-2) are timing charts showing waveforms of the drive signal and the masking signal in the reverse pass in the fourth embodiment. As shown in FIG. 23(*a*), in the reverse pass, the original drive signal DRV0 has four different pulses W25–W28 generated respectively in four partial periods T25–T28 in one pixel period. The four periods T25–T28 may also be set to have arbitrary lengths, respectively. The waveform of the original drive signal DRV0 over one pixel period in the reverse pass is different from the waveform in the forward pass (see FIG. 22(*a*)). In the reverse pass, in the case of non-dot recording, the masking signal MSK(i) masks all the pulses other than the first pulse W25 to generate a drive signal DRV(i). The masking signal MSK(i) masks all the pulses other than the third pulse W27 to record a small dot, masks all the pulses other than the second pulse W26 to record a medium dot, and masks all the pulses other than the fourth pulse W28 to record a large dot.

Figure 24:
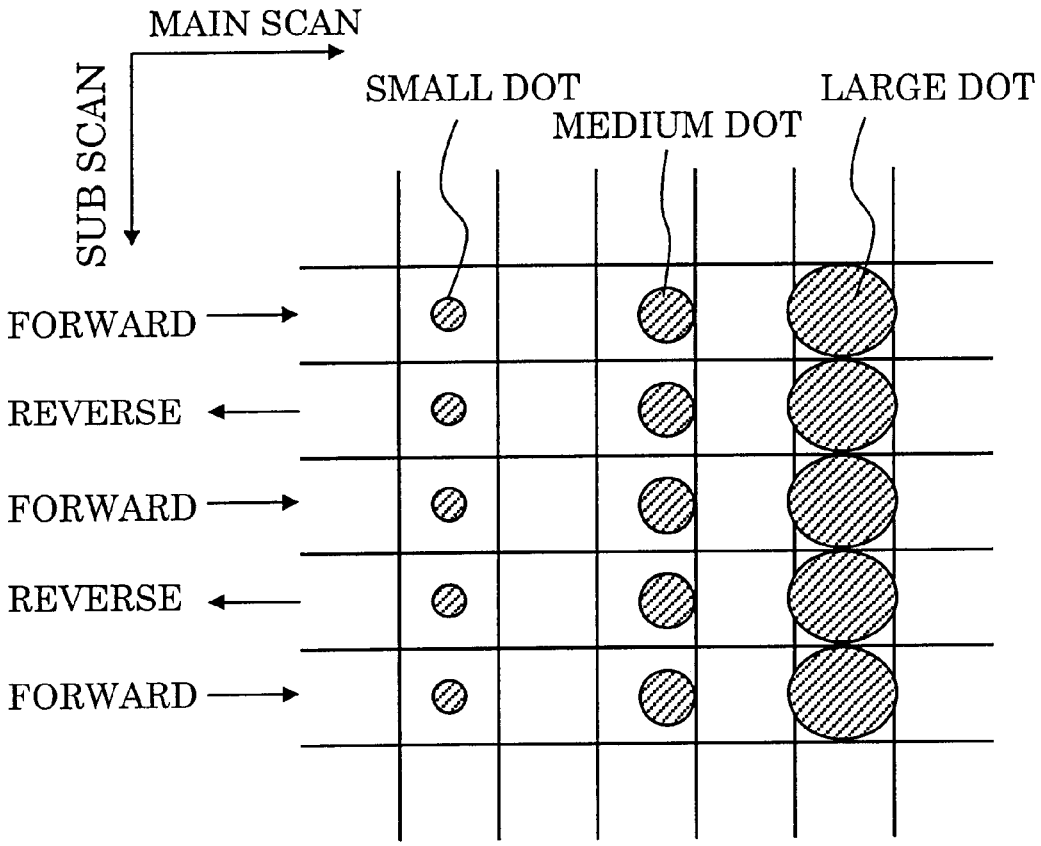
FIG. 24 is a timing chart showing waveforms of the drive signal and the masking signal during the reverse pass in the fourth embodiment.

FIG. 24 shows dots recorded in response to the drive signals DRV(i) shown in FIGS. 22(*a*)–22(*e*-2) and 23(*a*)–23(*e*-2). Small dots are recorded on the substantial centers of the respective pixel areas in both the forward and reverse passes. Medium dots are recorded at rightward positions in the respective pixel areas, whereas large dots are recorded over the whole pixel areas. The drive signals DRV(i) shown in FIGS. 22(*a*)–22(*e*-2) and 23(*a*)–23(*e*-2) substantially aligns the hitting positions of ink droplets in the forward and reverse passes.

Figure 25:
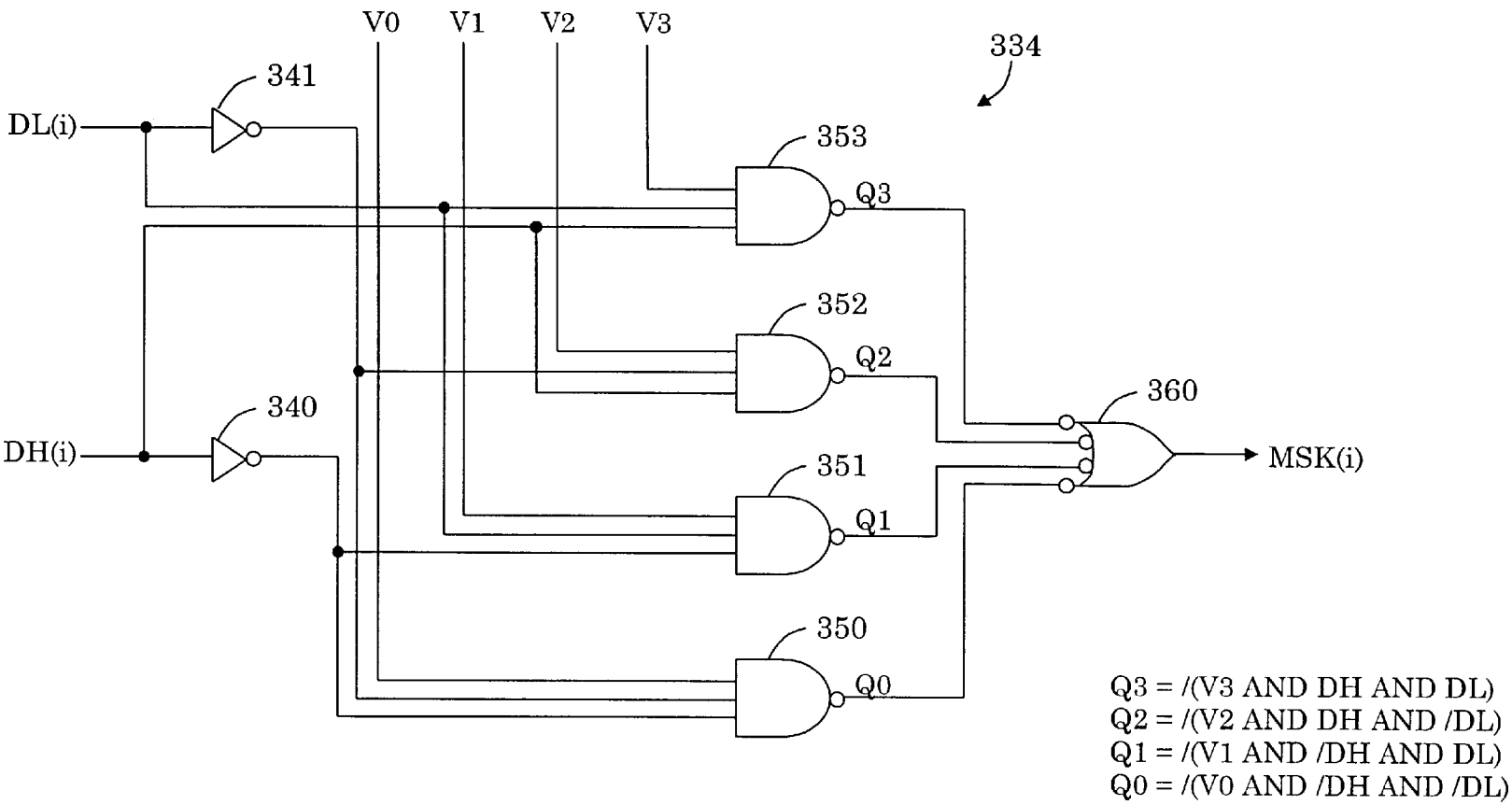
FIG. 25 is a block diagram illustrating the internal structure of a masking signal generating circuit 334.
Figure 31:
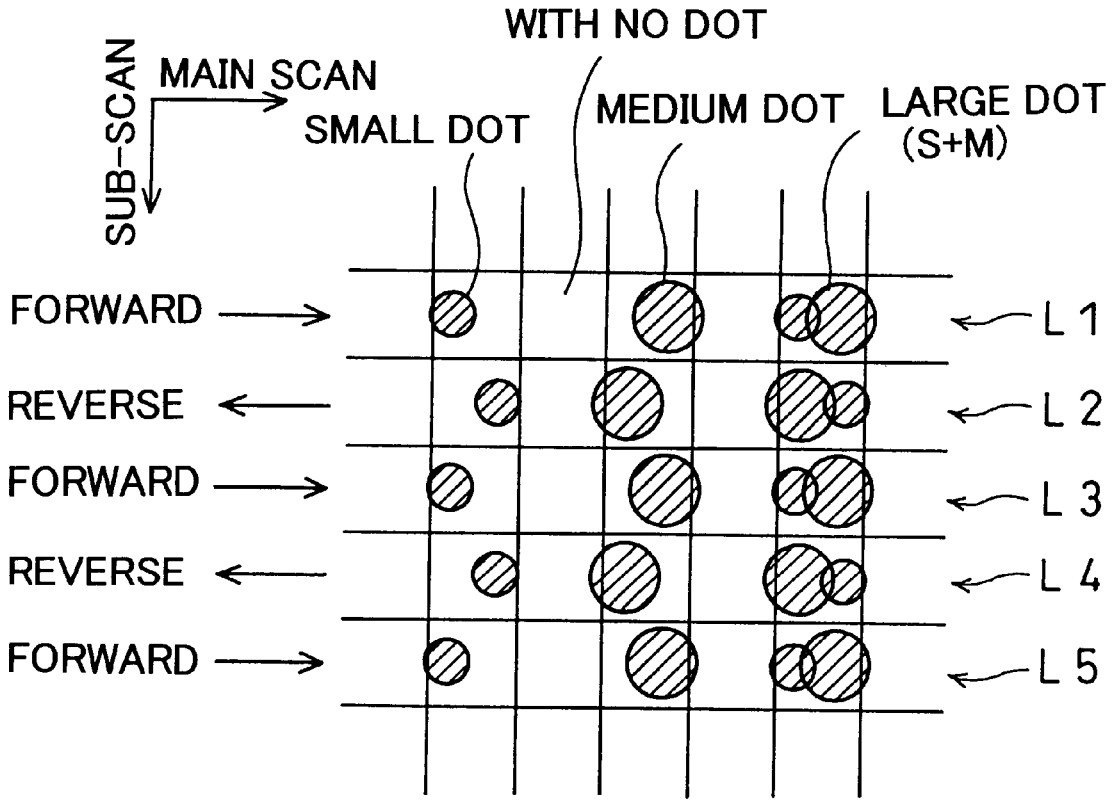

FIG. 25 is a block diagram illustrating the internal structure of the masking signal generation circuit 334. The masking signal generation circuit 334 has two inverters 341 and 342, four NAND circuits 350–353 that carry out logical operations with regard to the print signal PRT (DH, DL) and one of the mask pattern data V0–V3, and a NAND circuit 360 that outputs the masking signal MSK(i).

The four NAND circuits 350–351 are coupled so that they have outputs Q0–Q3 according to the following logical equations (1)–(4):

$$Q0=/(V0 \text{ AND } /DH \text{ AND } /DL) \quad (1)$$

$$Q1=/(V1 \text{ AND } /DH \text{ AND } DL) \quad (2)$$

$$Q2=/(V2 \text{ AND } DH \text{ AND } /DL) \quad (3)$$

$$Q3=/(V3 \text{ AND } DH \text{ AND } DL) \quad (4)$$

where the symbol '/' added before the signal name means that the signal is inverted.

The NAND circuit 360 at the final stage generates the masking signal MSK in response to the outputs Q0–Q3 of the four NAND circuits 350–353 according to the following logical equation (5):

$$MSK=(/Q0 \text{ OR } /Q1 \text{ OR } /Q2 \text{ OR } /Q3) \quad (5)$$

As readily understandable from the logical equations (1)–(5), when the value (DH, DL) of the 2-bit print signal PRT is equal to (0, 0), the level of the masking signal MSK is identical with the first mask pattern data V0. When the value of the print signal is equal to (0, 1), (1, 0), and (1, 1), the level of the masking signal MSK is identical with the mask pattern data V1, V2, and V3, respectively. The waveform of the masking signal MSK according to the value of the print signal PRT can thus be set arbitrarily by changing the values of the mask patter data V0–V3.

FIGS. 26(A) and 26(B) show truth tables used in the masking signal generation circuit 334 to obtain the masking signals MSK (FIGS. 22(*a*)–22(*e*2) and 23(*a*)–23(*e*-2)) in the fourth embodiment. Referring to FIG. 26(A), in the forward pass, the first mask pattern data V0 varies as 1, 0, 0, 0 in the periods T21–T24. The second mask pattern data V1 varies as 0, 0, 1, 0, the third mask pattern data V2 as 0, 0, 0, 1, and the fourth mask pattern data V3 as 0, 1, 0, 0. The variation in level of the masking signal MSK is identical with the variation in level of the first mask pattern data V0 when the value (DH, DL) of the print signal PRT is equal to (0, 0). The masking signal MSK accordingly has the values of 1, 0, 0, 0 in the respective periods T21–T24. This variation coincides with the waveform of the masking signal MSK shown in FIG. 22(*b*-1). In a similar manner, the variations of the masking signal MSK in the case of the value of the print signal PRT equal to (0, 1), (1, 0), and (1, 1) in FIG. 26(A) are respectively coincident with the variations in FIGS. 22(*c*-1), 22(*d*-1), and 22(*e*-1).

Referring to FIG. 26(B), in the reverse pass, the first mask pattern data V0 varies as 1, 0, 0, 0 in the periods T25–T28. The second mask pattern data V1 varies as 0, 0, 1, 0, the third mask pattern data V2 as 0, 1, 0, 0, and the fourth mask pattern data V3 as 0, 0, 0, 1. The variations of the masking signal MSK in the case of the value of the print signal PRT equal to (0, 0), (0, 1), (1, 0), and (1,1) in FIG. 26(B) are respectively coincident with the variations in FIGS. 22(*b*-1), 22(*c*-1), 22(*d*-1), and 22(*e*-1).

Like the other embodiments, in the fourth embodiment, the drive signal DRV(i) in one pixel period is shaped to have different waveforms corresponding to different values of the print signal PRT. The plural waveforms of the drive signal corresponding to the different values of the print signal PRT are different between the forward and reverse passes.

The arrangement of the fourth embodiment can independently and arbitrarily shape the waveform of the original drive signal DRV0 in the forward and reverse passes. The hitting positions of ink droplets can be substantially aligned in the forward and reverse passes as shown in FIG. 24 by generating the masking signal MSK for masking part or all the original drive signal DRV0 over one pixel period according to the value of the print signal PRT.

F. Fifth Embodiment

FIGS. 27(*a*), 27(*b*-1), 27(*b*-2), 27(*c*-1), 27(*c*-2), 27(*d*-1), 27(*d*-2), 27(*e*-1) and 27(*e*-2) are timing charts showing waveforms of the drive signal and the masking signal in the forward pass in a fifth embodiment. The drive signal generator is identical with that of the fourth embodiment (see FIGS. 17, 18, 21, and 25).

As shown in FIG. 27(*a*), in the forward pass, the original drive signal DRV0 has four different pulses W31–W34 generated respectively in four partial periods T31–T34 in one pixel period. The four periods T31–T34 may be set to have arbitrary lengths, respectively. As shown in FIGS. 27(*b*-1) and 27(*b*-2), when no dot is recorded, the masking signal MSK(i) masks all the pulses other than the first pulse W31 to generate a drive signal DRV(i). The masking signal MSK(i) masks all the pulses other than the fourth pulse W34 to record a small dot, masks all the pulses other than the third pulse W33 to record a medium dot, and masks all the pulses other than the second and third pulses W32 and W33 to record a large dot. The shapes of the four pulses W31–W34 and the periods masked according to the dot size are different from those in the fourth embodiment shown in FIGS. 22(*a*)–22(*e*-2).

FIGS. 28(*a*), 28(*b*-1), 28(*b*-2), 28(*c*-1), 28(*c*-2), 28(*d*-1), 28(*d*-2), 28(*e*-1) and 28(*e*-2) are timing charts showing waveforms of the drive signal and the masking signal in the reverse pass in the fifth embodiment. As shown in FIG. 28(*a*), in the reverse pass, the original drive signal DRV0 has four different pulses W35–W38 generated respectively in four partial periods T35–T38 in one pixel period. The four periods T35–T38 may also be set to have arbitrary lengths. The waveform of the original drive signal DRV0 over one pixel period in the reverse pass is different from the waveform in the forward pass (see FIG. 28(*a*)). In the reverse pass, in the case of non-dot recording, the masking signal MSK(i) masks all the pulses other than the first pulse W35 to generate a drive signal DRV(i). The masking signal MSK(i) masks all the pulses other than the second pulse W36 to record a small dot, masks all the pulses other than the fourth pulse W38 to record a medium dot, and masks all the pulses other than the third and fourth pulses W37 and W38 to record a large dot. In the reverse pass, the shapes of the four pulses W35–W38 and the periods masked according to the dot size are different from those in the fourth embodiment shown in FIGS. 23(*a*)–23(*e*-2). The waveforms as shown in FIGS. 28(*a*) and 29(*a*) are obtained by regulating the waveform data (see FIG. 20) stored in the ROM 310 in the original drive signal generation control circuit 302 (see FIG. 17).

FIGS. 29(A) and 29(B) show truth tables used in the masking signal generation circuit 334 to obtain the masking signals MSK in the fifth embodiment (FIG. 27(*a*)–27(*e*-2) and 28(*a*)–28(*e*-2)). Referring to FIG. 29(A), in the forward pass, the first mask pattern data V0 varies as 1, 0, 0, 0 in the periods T31–T34. The second mask pattern data V1 varies as 0, 0, 0, 1 the third mask pattern data V2 as 0, 0, 1, 0 and the fourth mask pattern data V3 as 0, 1, 1, 0. The variations of the masking signal MSK in the case of the value of the print signal PRT equal to (0, 0), (0, 1), (1, 0), and (1, 1) in FIG. 29(A) are respectively coincident with the variations in FIGS. 27(*b*-1), 27(*c*-1), 27(*d*-1), and 27(*e*-1).

Referring to FIG. 29(B), in the reverse pass, the first mask pattern data V0 varies as 1, 0, 0, 0 in the periods T35–T38. The second mask pattern data V1 varies as 0, 1, 0, 0, the third mask pattern data V2 as 0, 0, 0, 1, and the fourth mask pattern data V3 as 0, 0, 1, 1. The variations of the masking signal MSK in the case of the value of the print signal PRT equal to (0, 0), (0, 1), (1, 0), and (1, 1) in FIG. 29(B) are respectively coincident with the variations in FIGS. 28(*b*-1), 28(*c*-1), 28(*d*-1), and 28(*e*-1).

Like the other embodiments, in the fifth embodiment, the drive signal DRV(i) in one pixel period is shaped to have different waveforms corresponding to different values of the print signal PRT. The plural waveforms of the drive signal corresponding to the different values of the print signal PRT are varied between the forward and reverse passes.

The drive signal waveforms shown in FIGS. 27(*a*)–27(*e*-2) and FIGS. 28(*a*)–28(*e*-2) do not align the hitting positions of ink droplets so well as in the fourth embodiment shown in FIG. 24. Using the drive signal waveforms shown in FIGS. 27(*a*)–27(*e*-2) and FIGS. 28(*a*)–28(*e*-2), however, causes the hitting positions of ink droplets to be closer to an alignment to some extent in the forward and reverse passes. By using the waveforms of FIGS. 27(*a*)–27(*e*-2) and 28(*a*)–28(*e*-2), at least the quantities of ink droplets can be made equal in the forward and reverse passes. This effectively prevents the image quality from being deteriorated because of the difference in quantity of ink between the forward and reverse passes. The drive signal waveforms of the fourth embodiment shown in FIGS. 23(*a*)–23(*e*-2) and 24(*a*)–24(*e*-2) makes the quantities of ink droplets in the forward pass substantially equal to those in the reverse pass, and substantially aligns the hitting positions of ink droplets. The fourth embodiment is thus preferable to the fifth embodiment.

G. Sixth Embodiment

FIGS. 30(A) and 30(B) show truth tables used in the masking signal generation circuit 334 to generate the masking signals MSK in a sixth embodiment. The drive signal generator is identical with that of the fourth embodiment. In the sixth embodiment, the mask pattern data V0–V3 are set such that the variations in value of the masking signal MSK for the respective dots substantially coincide with those of the third embodiment shown in FIGS. 16(*a*-2) and 16(*b*-2). Accordingly, the original drive signal generating circuit 304 can generate the original drive signal DRV0 having the same waveforms as those of the drive signal for the large dot shown in FIGS. 16(*a*-3) and 16(*b*-3), so as to form dots substantially the same as those of the third embodiment.

As described above, the respective embodiments can shape the waveform of the drive signal DRV in a period of main scan for one pixel to N different waveforms corresponding to N different values of the print signal PRT (where N is an integer of at least 2). The N different waveforms of the drive signal DRV may be changed in the forward pass and the reverse pass. This arrangement, for example, can align the hitting positions of ink droplets in the main scanning direction in the forward and reverse passes. Furthermore, the quantities of ink droplets for forming the different sized dots can be made equal in the forward and reverse passes. Shaping the waveforms of the drive signal in the forward and reverse passes effectively prevents deterioration of the image quality because of the difference in printing properties (concretely, the ejection properties of nozzles) between the forward and reverse passes.

The present invention is not restricted to the above embodiments or their applications, but there may be many modifications, changes, and alterations without departing from the scope or spirit of the main characteristics of the present invention. Some examples of possible modification are given below.

(1) Part of the hardware configuration in the above embodiments may be implemented by software, and, on the contrary, part of the software configuration may be realized by hardware. By way of example, inversion of the print signal (masking signal) as shown in FIGS. 11(*a*-1) and 11(*b*-2) may be carried out inside the printer driver 96 (see FIG. 2), instead of in the control circuit of the printer 22.

(2) Each main scan may record all the pixels on each raster line or alternatively record only part of the pixels on each raster line, although this point is not specifically described in the respective embodiments. In the latter case, for example, part of the pixels on each raster line are recorded in the forward pass while the rest of the pixels are recorded in the reverse pass.

INDUSTRIAL APPLICABILITY

This invention is applicable to various bi-directional printing apparatus, such as inkjet printers, which can record each pixel with a variable-size ink dot.

What is claimed is:

1. A printer having, a function of bi-directional printing, for printing an image on a print medium during forward and reverse passes of main scan, the printer comprising:

a print head having a plurality of nozzles and a plurality of emission driving elements for causing emission of ink droplets respectively from the plurality of nozzles, each nozzle being adaptable to form a selected one of N different dots having different sizes in one pixel area on the print medium, where N is an integer of at least 2;

a main scanning drive section that effects bi-directional main scanning by moving at least one selected from the print medium and the print head;

a sub-scanning drive section that effects sub-scanning by moving at least one selected from the print medium and the print head; and a head drive control section that supplies a drive signal to each of the emission driving elements responsive to a print signal, the print signal having a plurality of bits for each pixel in order to record each pixel in multiple tones, wherein the head drive control section includes a drive signal generator that is adaptable to modify a shape of the drive signal within each one-pixel period of main scan to have N different waveforms corresponding to N different values of the print signal, the N different values of the print signal representing formation of the N different dots, the drive signal generator being adaptable to change the N different waveforms of the drive signal for aligning hitting positions of ink droplets on the print medium between the forward pass and the reverse pass.

2. A printer in accordance with claim 1, wherein the drive signal generator comprises:

an original drive signal generator that generates an original drive signal having a plurality of pulses within the one-pixel period of main scan, the original drive signal being commonly used for the plurality of emission driving elements;

a masking signal generator that generates N different masking signals corresponding to the N different values of the print signal, in order to selectively mask the plurality of pulses of the original drive signal; and a masking section that selectively masks the plurality of pulses of the original drive signal with respect to each of the emission driving elements with the masking signals, thereby generating the drive signal to be supplied to each of the emission driving elements;

wherein the masking signal generator changes waveforms of the N different masking signals corresponding to the N different values of the print signal between the forward pass and the reverse pass.

3. A printer in accordance with claim 2, wherein the original drive signal generator is adaptable to change the waveform of the original drive signal within each one-pixel period of main scan between the forward pass and the reverse pass.

4. A printer in accordance with claim 3, wherein the original drive signal generator includes:

a rewritable memory that stores a plurality of gradient values representing gradients of the waveform of the original drive signal;

an adder that adds a gradient value read from the memory with a fixed period to generate level data representing a level of the original drive signal;

a D-A converter that carries out D-A conversion of the level data to generate the original drive signal; and an original drive signal generation control section that causes the memory to selectively output one of the plurality of gradient values, and changes the plurality of gradient values between the forward pass and the reverse pass.

5. A printer in accordance with claim 1, wherein the drive signal generator is adaptable to generate a plurality of drive signal pulses within each one-pixel period of main scan for emitting the plurality of ink droplets in each one-pixel area on the print medium; and the drive signal generator reverses, within each one-pixel period of main scan, supply timing of at least one of the drive signal pulses in the one-pixel period to emit ink droplets, to the emission driving element between the forward pass and the reverse pass.

6. A printer in accordance with claim 5, wherein the drive signal generator includes a bit inverter that reverses bit positions in the multi-bit print signal between the forward pass and the reverse pass, thereby producing a bit-sequence modified signal; and the drive signal generator generates the drive signal pulses responsive to the bit-sequence modified signal.

7. A printer in accordance with claim 6, wherein the drive signal generator is adaptable to generate the plurality of drive signal pulses responsive to the bit-sequence modified signal such that the plurality of drive signal pulses have different waveforms, which are used to emit ink droplets having different amounts of ink, corresponding to the N different values of the print signal.

8. A printer in accordance with claim 7, wherein the drive signal generator further includes:

an original drive signal pulse generator that generates a plurality of original drive signal pulses having different waveforms in each one-pixel period of main scan and reverses generation timings of the plurality of original drive signal pulses within each one-pixel period of main scan between the forward pass and the reverse pass; and a masking section that masks the plurality of original drive signal pulses with the bit-sequence modified signal to generate the drive signal pulses used for recording each pixel.

9. A printer in accordance with claim 6, wherein the drive signal generator farther includes:

an original drive signal pulse generator that generates a plurality of original drive signal pulses having a substantially identical waveform within each one-pixel period of main scan, in order to cause a plurality of ink droplets having a substantially fixed amount of ink to be emitted within each one-pixel period of main scan; and a masking section that masks the plurality of original drive signal pulses with the bit-sequence modified signal to generate the drive signal pulses used for recording each pixel.

10. A printing method of printing an image on a print medium during forward and reverse passes of main scan, using a printer including a print head having a plurality of nozzles and a plurality of emission driving elements for causing emission of ink droplets respectively from the plurality of nozzles, each nozzle being adaptable to form a selected one of N different dots having different sizes in one pixel area on the print medium, where N is an integer of at least 2, the printing method comprising the step of:

(a) modifying a shape of the drive signal within each one-pixel period of main scan to have N different waveforms corresponding to N different values of the print signal, the N different values of the print signal representing formation of the N different dots, while changing the N different waveforms of the drive signal for aligning hitting positions of ink droplets on the print medium between the forward pass and the reverse pass.

11. A printing method in accordance with claim 10, wherein the step (a) comprises the steps of:

(b) generating an original drive signal having a plurality of pulses within the one-pixel period of main scan, the original drive signal being commonly used for the plurality of emission driving elements;

(c) generating N different masking signals corresponding to the N different values of the print signal, in order to selectively mask the plurality of pulses of the original drive signal; and (d) selectively masking the plurality of pulses of the original drive signal with respect to each of the emission driving elements with the masking signals, thereby generating the drive signal to be supplied to each of the emission driving elements;

wherein the step (c) includes the step of changing waveforms of the N different masking signals corresponding to the N different values of the print signal between the forward pass and the reverse pass.

12. A printing method in accordance with claim 11, wherein the step (b) includes the step of:

(i) changing the waveform of the original drive signal within each one-pixel period of main scan between the forward pass and the reverse pass.

13. A printing method in accordance with claim 12, wherein the step (i) includes the steps of:

selecting one of a plurality of gradient values representing gradients of the waveform of the original drive signal;

adding the selected gradient value with a fixed period to generate level data representing a level of the original drive signal;

carrying out D-A conversion of the level data to generate the original drive signal; and changing the plurality of gradient values between the forward pass and the reverse pass.

14. A printing method in accordance with claim 10, wherein the step (a) includes the step generating a plurality of drive signal pulses within each one-pixel period of main scan for emitting the plurality of ink droplets in each one-pixel area on the print medium, while reversing, within each one-pixel period of main scan, supply timing of at least one of the drive signal pulses in the one-pixel period to emit ink droplets, to the emission driving element between the forward pass and the reverse pass.

15. A printing method in accordance with claim 14, wherein the step (e) includes the steps of:

(i) reversing bit positions in the multi-bit print signal between the forward pass and the reverse pass, thereby producing a bit-sequence modified signal; and (ii) generating the drive signal pulses responsive to the bit-sequence modified signal.

16. A printing method in accordance with claim 15, wherein the step (ii) includes the step of:

(iii) generating the plurality of drive signal pulses responsive to the bit-sequence modified signal;

wherein the plurality of drive signal pulses are generated as pulses having different waveforms, which are used to emit ink droplets having different amounts of ink, corresponding to the N different values of the print signal.

17. A printing method in accordance with claim 16, wherein the step (iii) includes the steps of:

generating a plurality of original drive signal pulses having different waveforms in each one-pixel period of main scan and reversing generation timings of the plurality of original drive signal pulses within each one-pixel period of main scan between the forward pass and the reverse pass; and masking the plurality of original drive signal pulses with the bit-sequence modified signal to generate the drive signal pulses used for recording each pixel.

18. A printing method in accordance with claim 15, wherein the step (e) further includes the steps of:

generating a plurality of original drive signal pulses having a substantially identical waveform within each one-pixel period of main scan, in order to cause a plurality of ink droplets having a substantially fixed amount of ink to be emitted within each one-pixel period of main scan; and masking the plurality of original drive signal pulses with the bit-sequence modified signal to generate the drive signal pulses used for recording each pixel.

19. A computer program product for causing a computer to print an image on a print medium during forward and reverse passes of main scan, the computer comprising a printer including a print head having a plurality of nozzles and a plurality of emission driving elements for causing emission of ink droplets respectively from the plurality of nozzles, each nozzle being adaptable to form a selected one of N different dots having different sizes in one pixel area on the print medium, where N is an integer of at least 2, the computer program product comprising:

a computer readable medium; and computer program code means stored on the computer readable medium, the computer program code means including, computer program for causing a computer to modify a shape of the drive signal within each one-pixel period of main scan to have N different waveforms corresponding to N different values of the print signal, the N different values of the print signal representing formation of the N different dots, while changing the N different waveforms of the drive signal for aligning hitting positions if ink droplets on the print medium between the forward pass and the reverse pass.

* * * * *